US010130187B1

(12) United States Patent
Clark

(10) Patent No.: US 10,130,187 B1
(45) **Date of Patent: *Nov. 20, 2018**

(54) KNEELER

(71) Applicant: Bruce A. Clark, St. Paul, MN (US)

(72) Inventor: Bruce A. Clark, St. Paul, MN (US)

( * ) Notice: Subject to any disclaimer, the term of this patent is extended or adjusted under 35 U.S.C. 154(b) by 44 days.

This patent is subject to a terminal disclaimer.

(21) Appl. No.: 15/147,683

(22) Filed: May 5, 2016

Related U.S. Application Data

(60) Provisional application No. 62/203,705, filed on Aug. 11, 2015.

(51) Int. Cl.
*A47C 16/04* (2006.01)
*E05B 1/00* (2006.01)

(52) U.S. Cl.
CPC ..... *A47C 16/04* (2013.01); *E05B 1/0069* (2013.01)

(58) Field of Classification Search
CPC ..... E05B 1/0069; A47C 16/04; A47C 7/62
See application file for complete search history.

(56) References Cited

U.S. PATENT DOCUMENTS

| | | | | |
|---|---|---|---|---|
| 830,103 | A | 9/1906 | Rundell | |
| 1,529,498 | A | 3/1925 | Novak | |
| 2,225,696 | A | 12/1940 | Holzderber | |
| 2,318,416 | A | 5/1943 | Peirce | |
| 2,829,705 | A | 4/1958 | Godshalk et al. | |
| D208,513 | S | 9/1967 | Rawald | |
| 4,394,049 | A | 7/1983 | Ward | |
| D273,996 | S | 5/1984 | Rasler | |
| 4,606,576 | A | 8/1986 | Jones | |
| D287,074 | S | 12/1986 | Ritchie | |
| 4,798,264 | A * | 1/1989 | Miller | A47C 16/04 182/228.1 |
| D305,522 | S | 1/1990 | Kohus | |
| D311,282 | S | 10/1990 | Tooley | |
| 4,971,389 | A | 11/1990 | Staggs | |
| 5,125,646 | A | 6/1992 | Wilkinson | |
| D331,330 | S | 12/1992 | Bennett et al. | |
| D346,310 | S | 4/1994 | Schlesier et al. | |
| D351,738 | S | 10/1994 | Lacombe | |
| D369,842 | S | 5/1996 | Gvoich | |
| D376,481 | S | 12/1996 | Bidwell et al. | |
| D387,623 | S | 12/1997 | Brooks | |
| D423,290 | S | 4/2000 | Green | |
| D435,196 | S | 12/2000 | Gregor et al. | |
| D463,039 | S | 9/2002 | Tseng | |
| D510,699 | S | 10/2005 | Crain et al. | |
| D541,433 | S | 4/2007 | Wise | |
| D612,160 | S | 3/2010 | Carino | |
| D685,110 | S | 6/2013 | Lusin et al. | |
| 9,420,893 | B1 * | 8/2016 | Clark | A47C 16/04 |

(Continued)

FOREIGN PATENT DOCUMENTS

| | | |
|---|---|---|
| GB | 762869 | 12/1956 |

*Primary Examiner* — Philip F Gabler
(74) *Attorney, Agent, or Firm* — Richard O. Bartz

(57) ABSTRACT

A kneeler for supporting a person in a kneeling position has a platform including a cushion for a person's knees when in a kneeling position. The corners of the platform have pockets for holding upright handles and allowing the upright handles to be separated from the platform. The handles facilitate a person to use their arms to move from an upright position to a kneeling position and move back from a kneeling position to an upright position.

24 Claims, 27 Drawing Sheets

(56) References Cited

U.S. PATENT DOCUMENTS

| | | | | |
|---|---|---|---|---|
| 2004/0201268 | A1 | 10/2004 | Liao | |
| 2012/0135254 | A1 * | 5/2012 | Kahrom | A01N 25/24<br>428/454 |

* cited by examiner

KNEELER

CROSS REFERENCE TO RELATED APPLICATION

This application claims the priority of U.S. Patent Application Ser. No. 62/203,705 filed Aug. 11, 2015.

FIELD OF THE INVENTION

The invention is in the art of a support for a person in a kneeling position that facilitates movement of the person from an upright position to a kneeling position and arising from the kneeling position to an upright position.

BACKGROUND OF THE INVENTION

Kneeler devices have been used to provide support when a person is kneeling and performing tasks such as cleaning a floor or object, painting, gardening or meditation. These kneeler devices have platforms or boards having cushions to support a person in a comfortable kneeling position. Handles associated with the platforms provide structures for aiding a person using the kneeler device in assuming a kneeling position and arising therefrom. Examples of kneeling aids and stools are disclosed in U.S. Pat. Nos. 2,318,416 and 4,850,069.

Bacterial touch surface contamination in hospital and medical clinic is associated with inadequate cleaning of equipment and rooms. Studies have been conducted to assess whether a lower environment bio-burden on critical touch surfaces would result in a lower risk of contracting an infection while hospitalized. Kneeler devices have not addressed bacterial contamination during use, transport and storage of the kneeler devices. There is a continuing need for a kneeler device that is easy to assemble without tools and effective to minimize microorganism contamination in an environment, including hospitals, medical clinics and physical therapy facilities.

The inability of a person to kneel after knee surgery is a cause of dissatisfaction. Kneeling can be a painful experience for persons with degenerative conditions of the knee both before and after surgery. No kneeling after surgery limits a person's ability to perform the activities of daily living. Some persons may need to kneel to return to perform to full employment and other persons may need to kneel to care for children or undertake leisure activities such as gardening and home improvement. Some religions have ceremonies that include the ability to kneel. All these activities contribute to improving a person's quality of life. Physical therapy intervention can improve a person's kneeling ability following knee surgery. Experienced therapist during routine clinic visits can provide a person with clear advice and instructions on kneeling and use of a kneeling device. Barriers to kneeling include scar position, numbness, range of flexion, involvement of other joints and pain. Kneeling ability with a therapist and a kneeling device can mitigate these barriers to a person's kneeling.

SUMMARY OF THE INVENTION

The kneeler of the invention has a platform and handles attached to opposite ends of the platform. The platform supports a cushion which functions as a rest for the knees of a person in a kneeling position. Bosses on corners of the platform have upwardly converging conical pockets. Feet attached to the handles have cone members located in the pockets that are in compression engagement with the bosses to firmly mount the handles on the platform. The handles can be removed from the platform by releasing the feet from the bosses. The assembly and release of the handles relative to the platform is accomplished with tools and separate connecting structures. The handles have antimicrobial copper alloy legs which substantially destroys microorganisms that adhere on the legs. The platform can also have antimicrobial materials that inhibit microorganism contamination. The kneeler has three components, the platform and two handles attached to feet, that can be assembled and taken apart in a minimum amount of time without tools or extra hardware. The handles can be identical or have different lengths for special needs. The kneeler has numerous uses, including but not limited to gardening, home and institutional cleaning, painting and carpet installation. Further use of the kneeler includes physical therapy exercising and assistance for infirmed and elderly persons.

DESCRIPTION OF THE KNEELERS

Figures 1, 2:
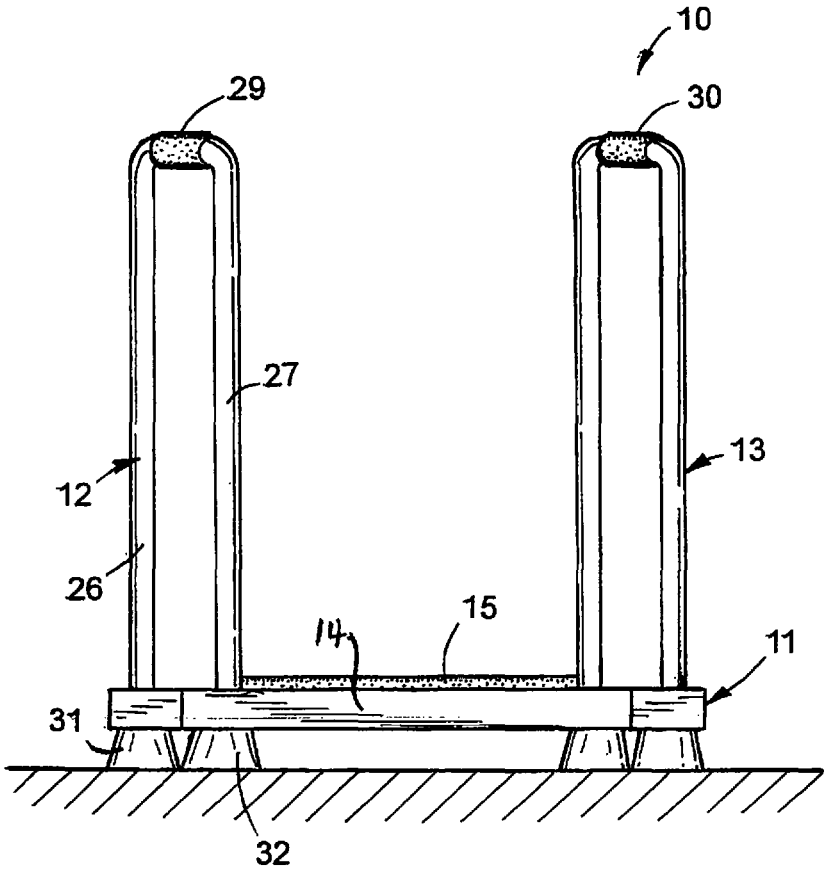
FIG. 1 is a top plan view of a first embodiment of the kneeler of the invention.
FIG. 2 is a rear elevational view thereof.
Figure 3:
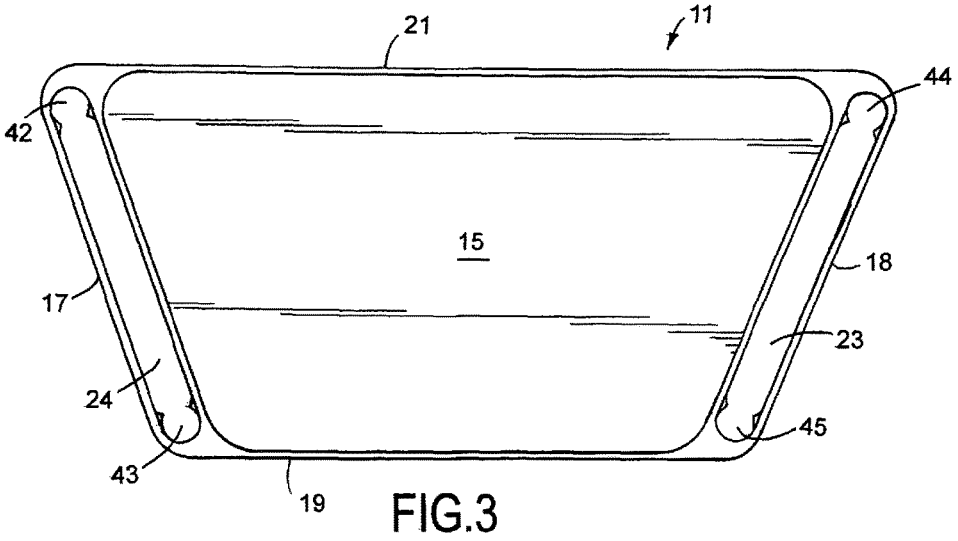
FIG. 3 is an enlarged top plan view of the platform of the kneeler of FIG. 1.
Figure 4:
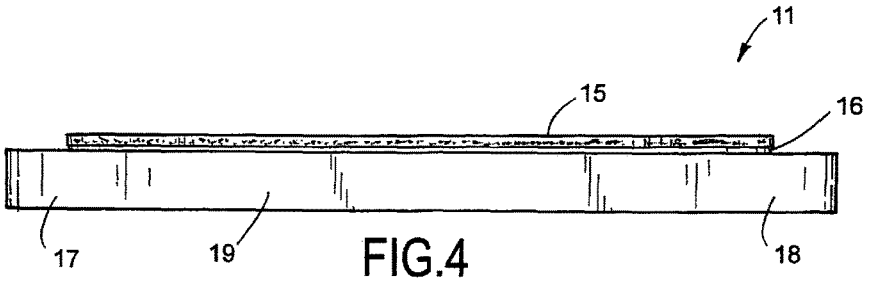
FIG. 4 is a front elevational view of FIG. 3.
Figure 5:
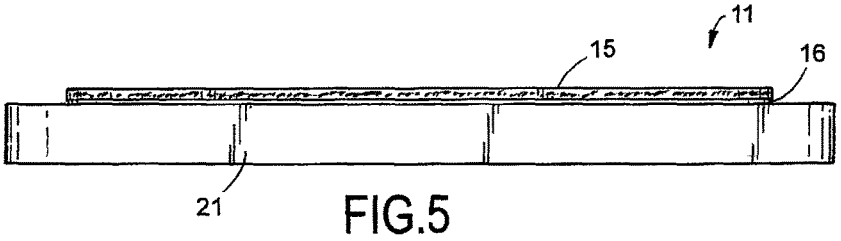
FIG. 5 is a rear elevational view of FIG. 3.
Figure 6:
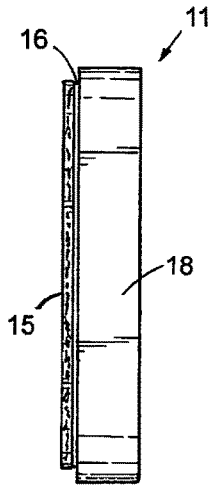
FIG. 6 is a side elevational of the right side of FIG. 3.
Figure 7:
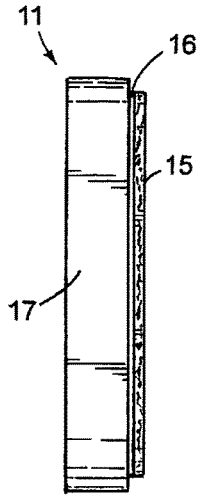
FIG. 7 is a side elevational view of the left side of FIG. 3.
Figure 9:
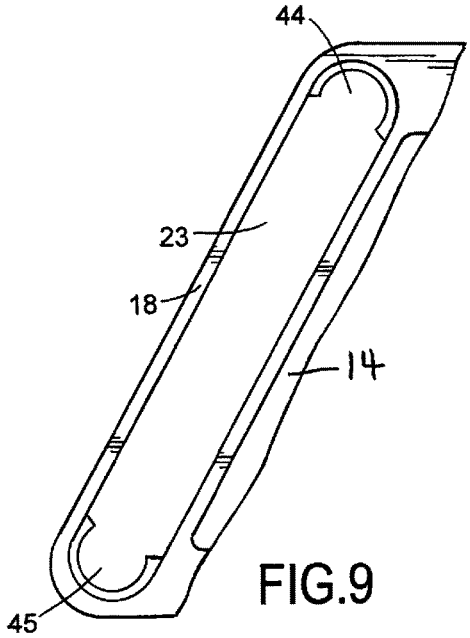
FIG. 9 is an enlarged bottom plan view of the left side of FIG. 8.
Figure 8:
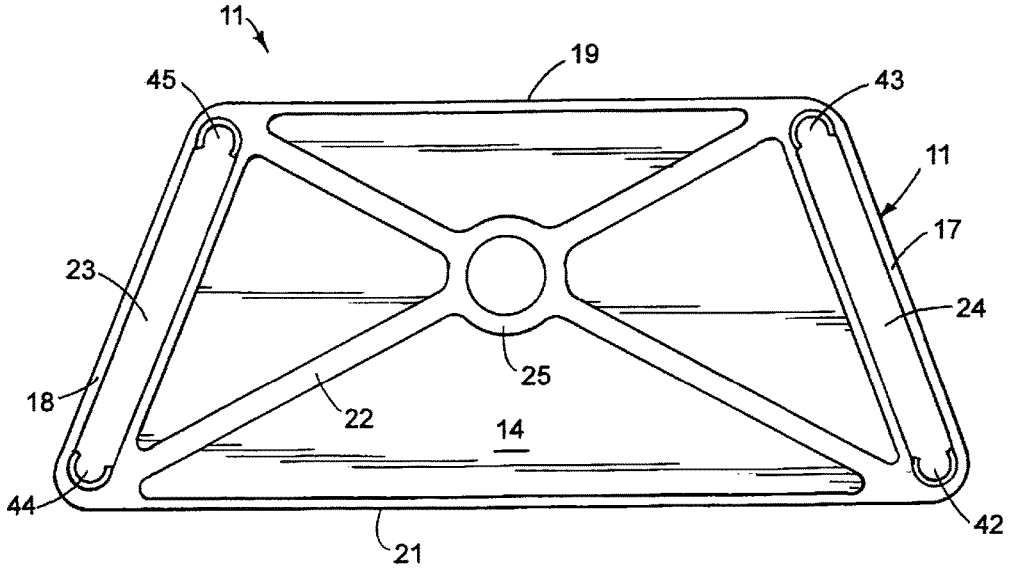
FIG. 8 is a bottom plan view of FIG. 3.
Figure 10:
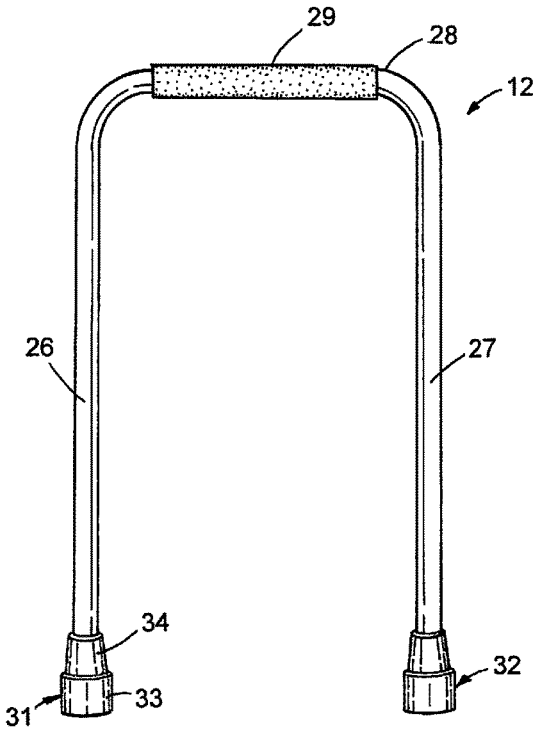
FIG. 10 is a side elevational view of a handle of the kneeler of FIG. 1.
Figure 11:
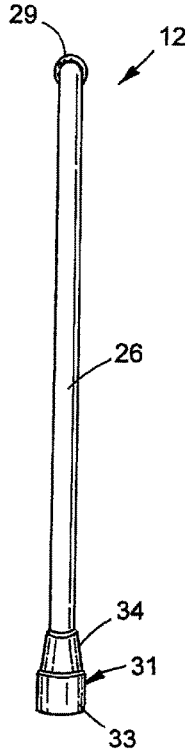
FIG. 11 is an end elevational view of the handle of FIG. 10.
Figure 12:
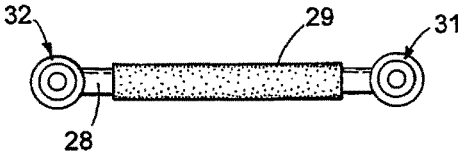
FIG. 12 is a bottom plan view of FIG. 10.
Figure 13:
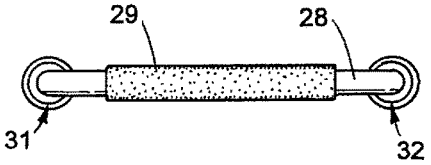
FIG. 13 is a top plan view of FIG. 10.
Figure 18:
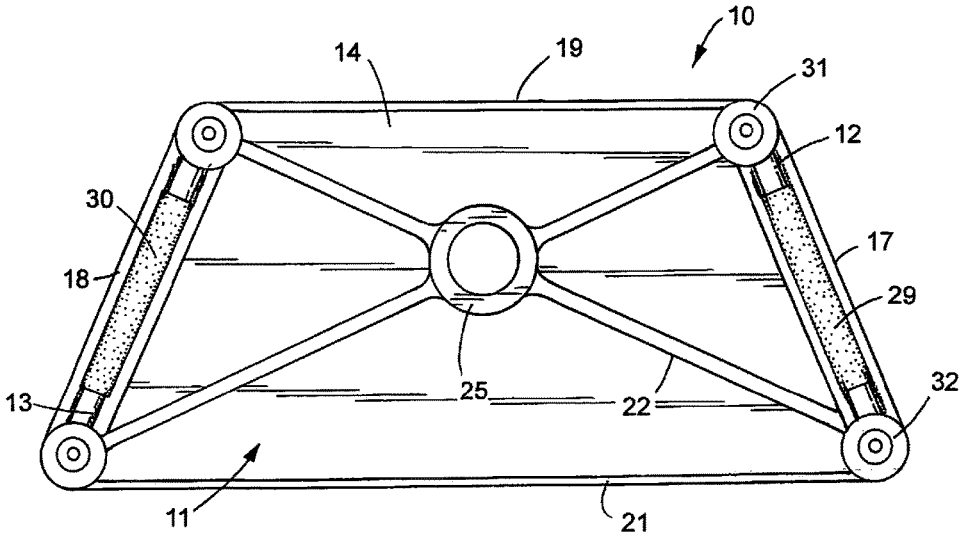
FIG. 18 is a bottom plan view of FIG. 17.

The first embodiment of a kneeler 10, shown in FIGS. 1 to 20, has a platform 11 and upright handles 12 and 13. Platform 11 includes a generally flat base or plate 14 having a top surface supporting a cushion or pad 15, such as a closed cell foam plastic member. Other types of cushions can be attached to the top surface of base 14. An adhesive 16 secures cushion 15 to the top surface of base 14. Base 14 has a quadrilateral shape having nonparallel side walls 17 and 18 and parallel rear and front walls 19 and 21. As shown in FIGS. 18 and 20, the bottom of base 14 has ribs 22 extended from a central cylindrical boss 25 to corner portions of base 14. Ribs 22 and boss 25 reinforce and maintain the generally flat configuration of base 14. As shown in FIGS. 3 and 8, the opposite sides of base 14 have elongated openings 23 and 24. The opposite ends of opening 23 communicate with pockets 44 and 45. Pockets 42 and 43 are open to opposite ends of opening 24. Pockets 43 and 45 are located in the rear corner portions of base 14 at the opposite ends of rear wall 19. Pockets 42 and 44 are located in the front corner portions of base 14 at the opposite ends of front wall 21. Base 14 is a one-piece metal member, such as cast aluminum or copper. Other materials including plastics and fiber reinforced plastics can be used for base 14.

Figure 14:
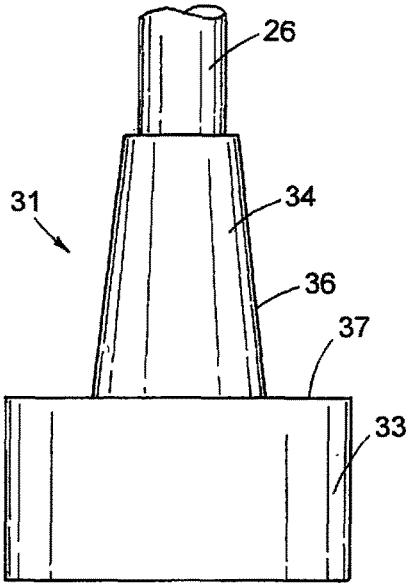
FIG. 14 is an enlarged front elevational view of one foot of the handle of FIG. 10.
Figure 16:
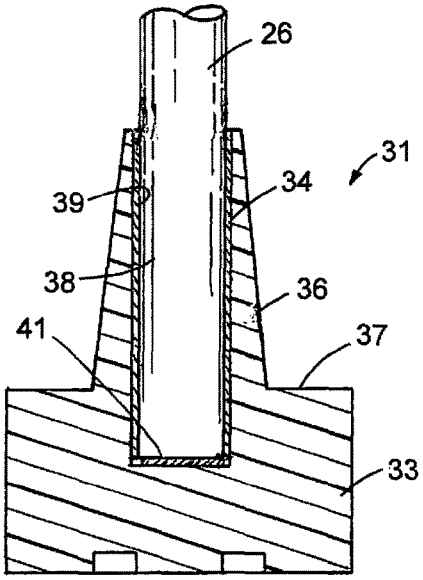
FIG. 16 is a sectional view taken along line 16-16 of FIG. 15.
Figure 15:
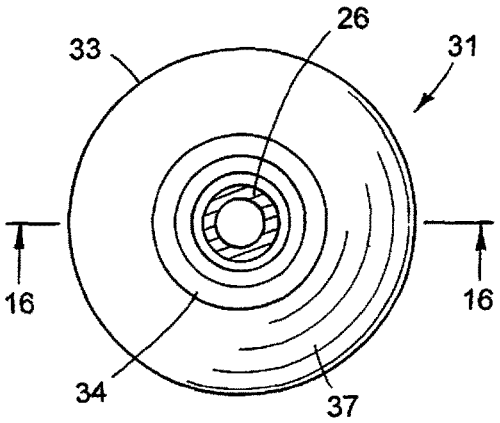
FIG. 15 is a top plan view of FIG. 14.
Figure 17:
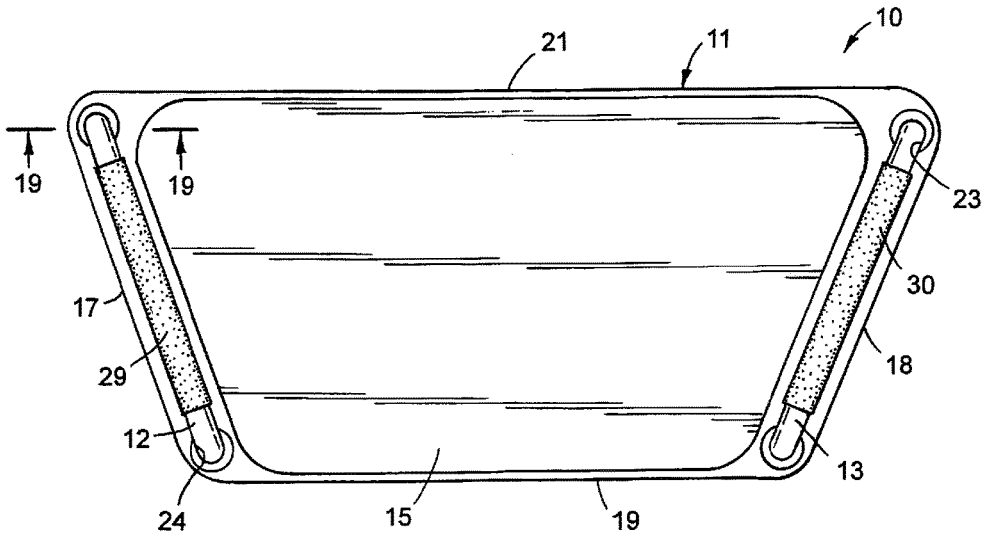
FIG. 17 is an enlarged top plan view of the kneeler of FIG. 1.

Handle 12, shown in FIGS. 10 to 13, has tubular legs 26 and 27 joined with a cross member 28. Legs 26 and 27 are a one-piece tubular member formed into an inverted U-shape. The tubular member has a rigid metal construction, such as steel or copper, that reduces twisting and bending of the tubular member. Other materials, such as plastic rods can be used to construct handle 12. A sleeve or grip 29 is mounted on cross member 28. Sleeve 29 is a tubular closed cell plastic member that fits around cross member 28. A foot 31 is attached to lower end 38 of leg 26. A second foot 32 is attached to the lower end of leg 27. As shown in FIGS. 14 to 16, foot 31 has a cylindrical shoe or base 33 and an upright cone shaped member or stem 34. Base 33 and stem 34 are a one-piece rubber or rubber-like member. Stem 34 has an upwardly tapered side wall 36 converging upwardly from an annular shoulder 37 on the top of shoe 33. Stem 34 and base 33 have a blind hole surrounded with a sleeve 39. A washer or disk 41 is located in the bottom of the blind hole. As shown in FIG. 16, leg end 38 fits with a tight fit into sleeve 39 and engages disk 41. Sleeve 39 and disk 41 reinforce the rubber material of foot 31. Foot 32 has the same structure as foot 31.

Figure 19:
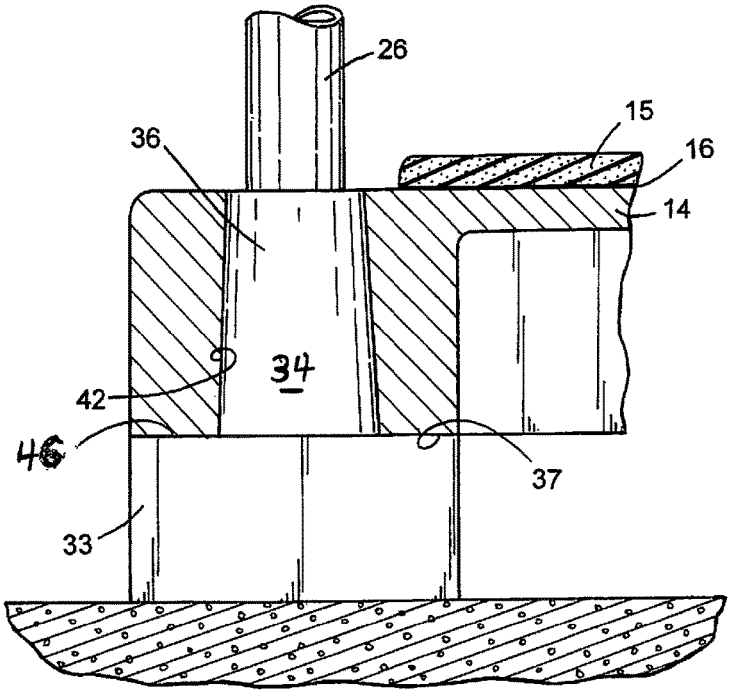
FIG. 19 is an enlarged sectional view taken along line 19-19 of FIG. 17.
Figure 20:
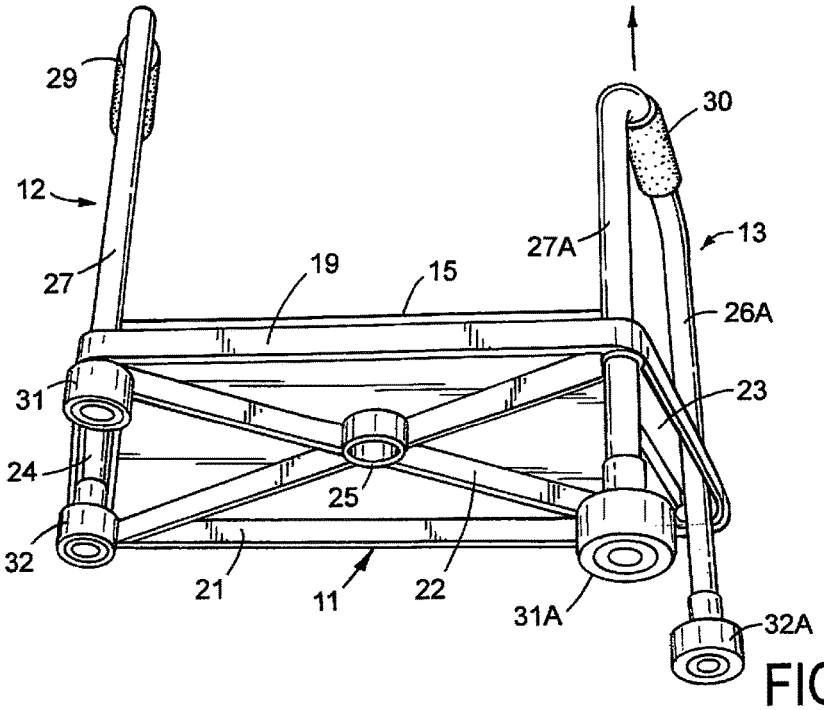
FIG. 20 is a perspective view of the kneeler showing the fitting of the handle on the platform assembly.
Figure 21:
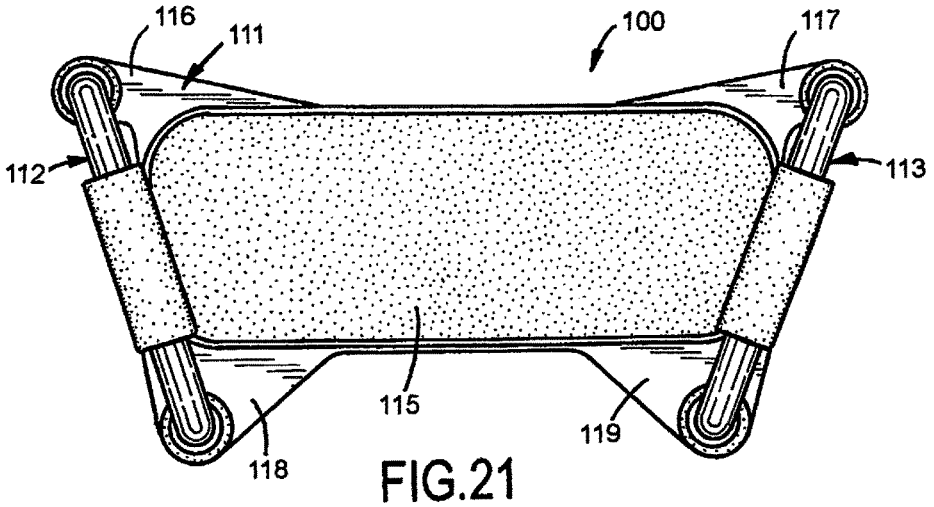
FIG. 21 is a top plan view of a second embodiment of the kneeler of the invention.
Figure 22:
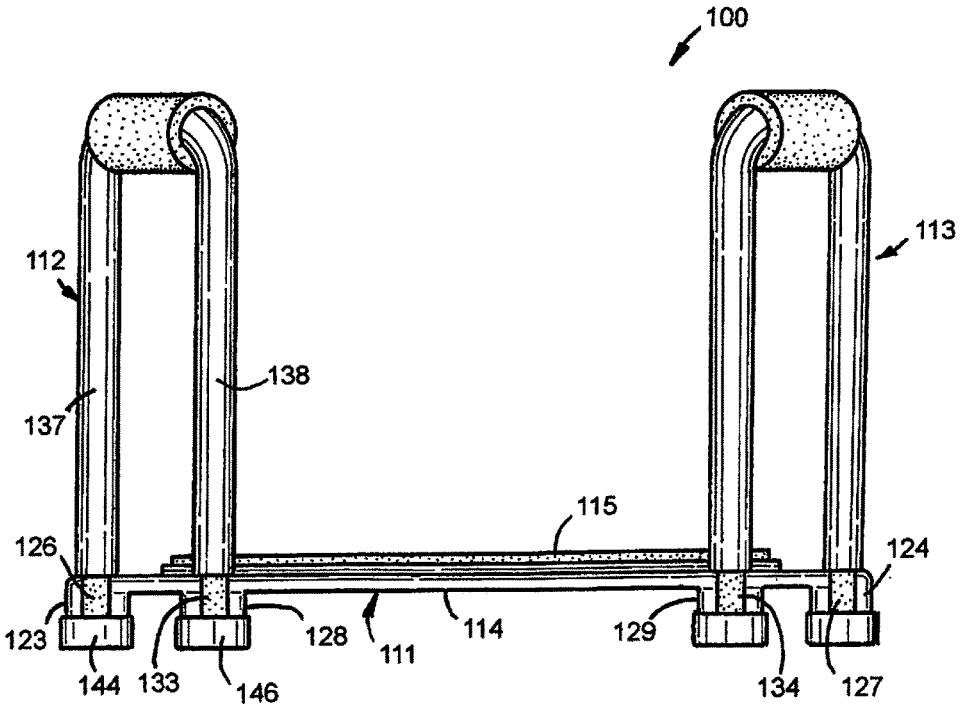
FIG. 22 is a rear elevational view of FIG. 21.
Figure 23:
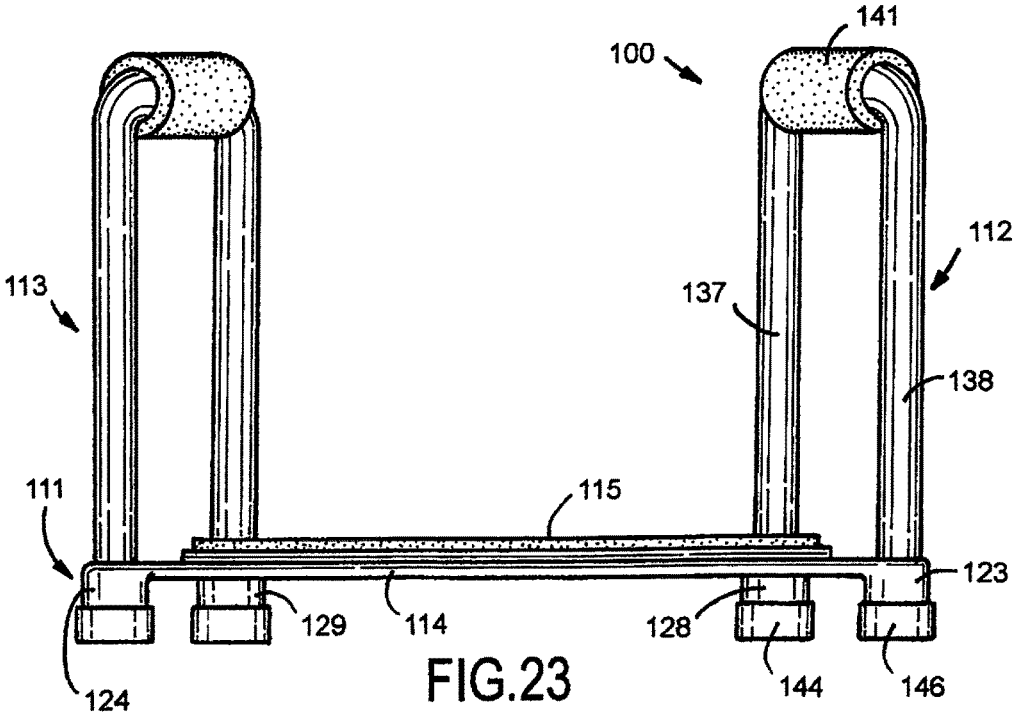
FIG. 23 is a front elevational view of FIG. 21.
Figure 24:
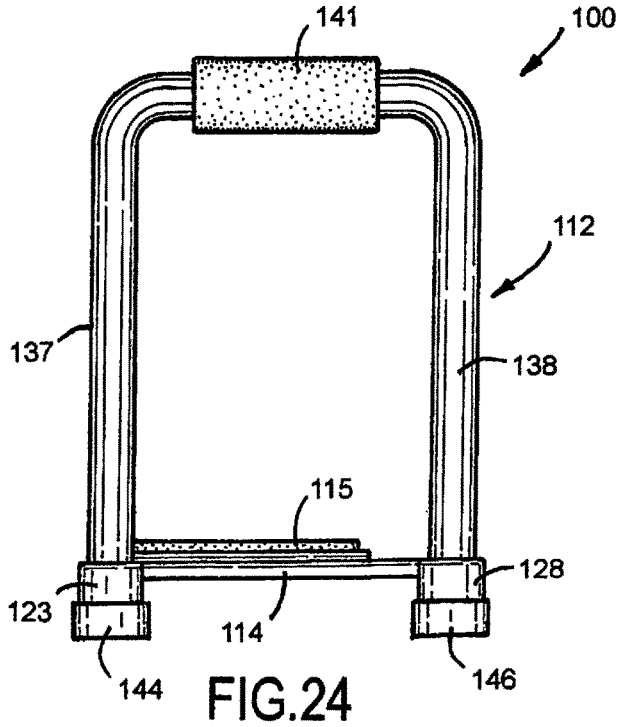
FIG. 24 is a side elevational view of the left side of FIG. 21.
Figure 25:
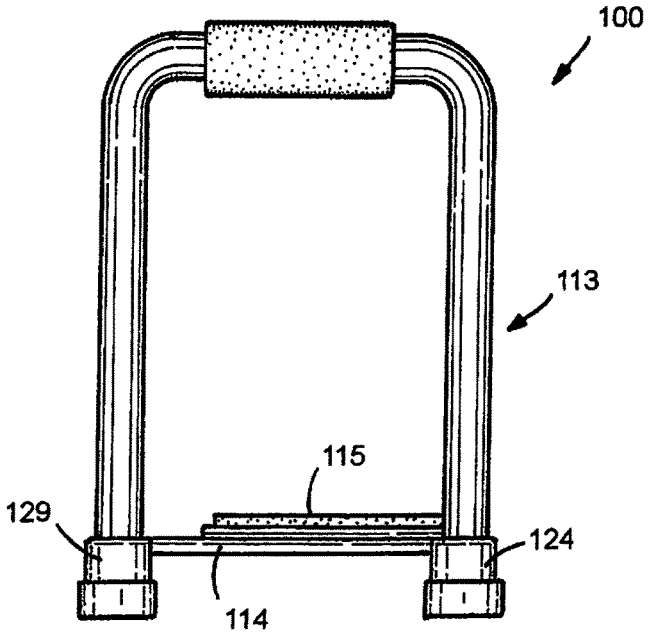
FIG. 25 is a side elevational view of the right side of FIG. 21.
Figure 26:
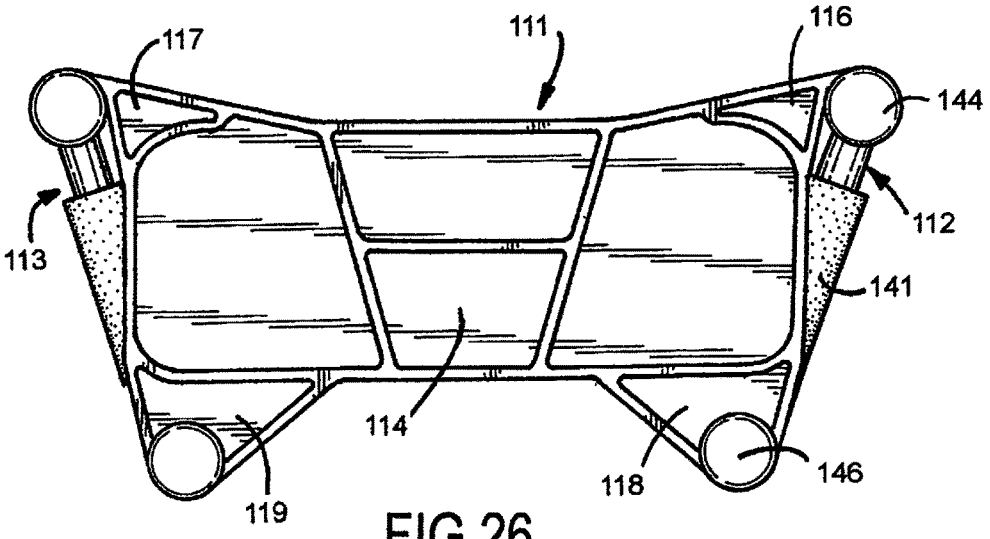
FIG. 26 is a bottom plan view of FIG. 21.
Figure 27:
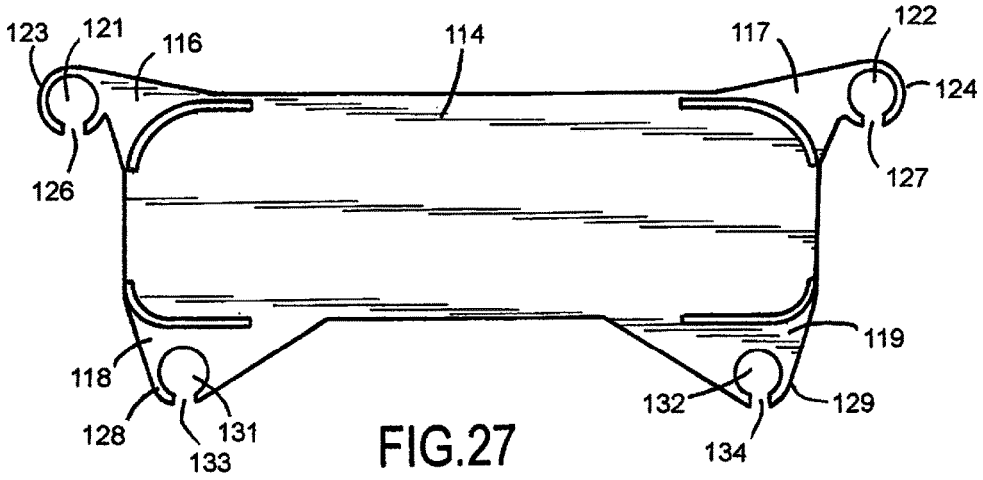
FIG. 27 is a top plan view of the platform of the kneeler of FIG. 21.
Figure 28:
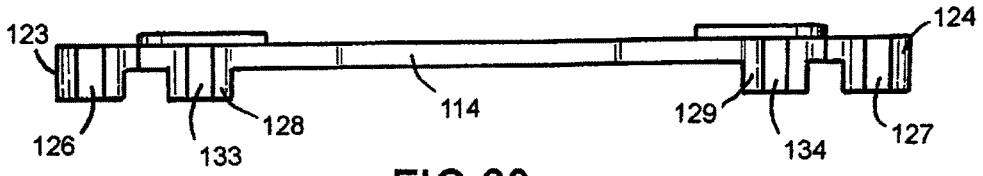
FIG. 28 is a back elevational view of the platform of FIG. 27.
Figure 29:
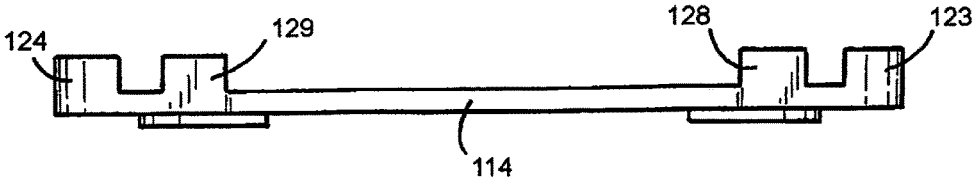
FIG. 29 is a front elevational view of the platform of FIG. 27.
Figure 31:
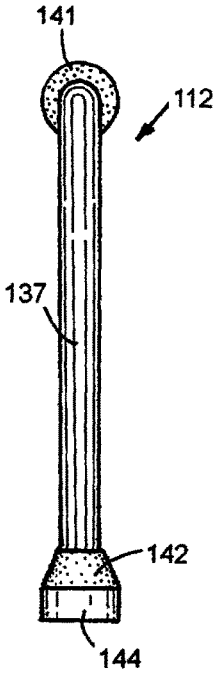
FIG. 31 is a side elevational view of the left side of FIG. 30.
Figure 30:
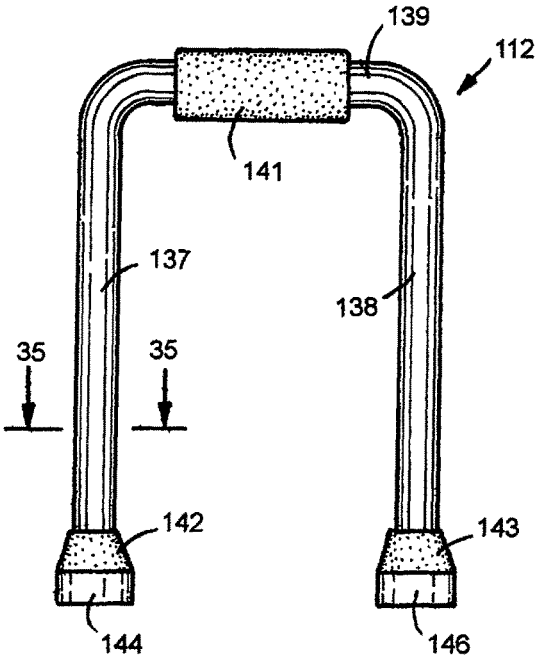
FIG. 30 is a side elevational view of a leg assembly of the kneeler of FIG. 21.
Figure 32:
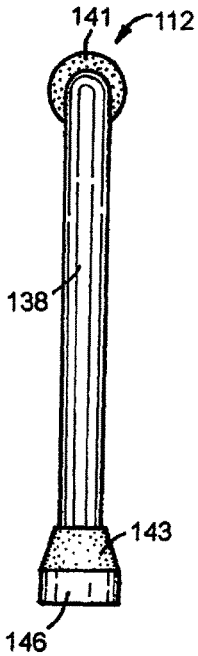
FIG. 32 is a side elevational view of the right side of FIG. 30.
Figure 33:
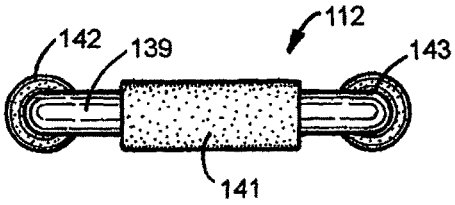
FIG. 33 is a top plan view of FIG. 30.
Figure 34:
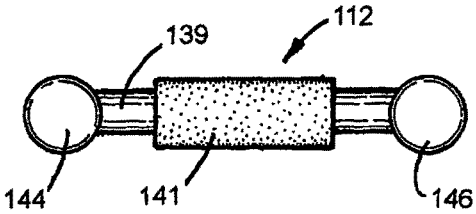
FIG. 34 is a bottom plan view of FIG. 30.
Figure 35:
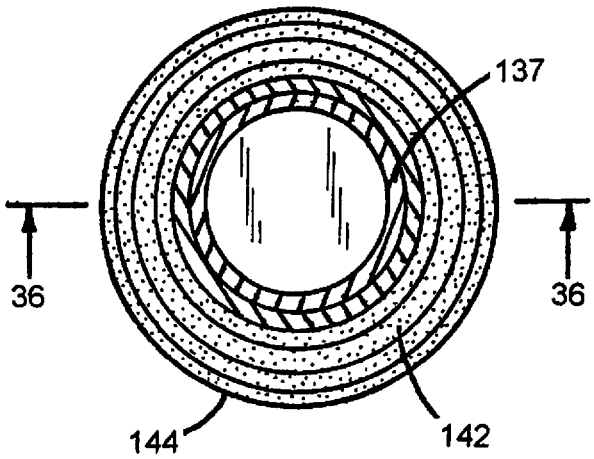
FIG. 35 is an enlarged sectional view taken along line 35-35 of FIG. 30.

As shown in FIGS. 19 and 20, stem 34 fits in pocket 42 in base 14. Shoulder 37 engages a bottom portion 46 of base 14. Tapered wall 36 of stem 34 is in a tight compression engagement with the tapered wall of pocket 42. Handles 13 and feet 31A and 32A have the same structure as handle 12 and feet 31 and 32. As shown in FIG. 20, handle 13 is assembled on platform 11 by inserting the upper ends of legs 26A and 27A and sleeve 30 upwardly from the bottom through opening 23. Platform 11 is moved down to locate the stems of feet 31A and 32A into pockets 44 and 45. Handle 12 is assembled on platform 11 by inserting handle 12 upwardly from the bottom of opening 24. Platform 11 is then moved down to locate the stems of feet 31 and 32 into pockets 42 and 43. Handles 12 and 13 are separated from platform 11 by moving platform 11 upwardly away from the feet associated with the handles. The tapered stems of feet 31, 32, 31A and 32A move away from the adjacent pockets 42-45 allowing handles 12 and 13 to be moved out of openings 23 and 24. Kneeler 10 is separated into three pieces, platform 11 and handles 12 and 13.

A second embodiment of the kneeler 100, shown in FIGS. 21 to 36, has a platform 111 supporting handles 112 and 113. Handles 112 and 113 extended upwardly from opposite ends of platform 111 provide supports for a person using kneeler 100. Platform 111 has a base or plate 114 having a flat top surface supporting a generally rectangular cushion or pad 115 of elastic material, such as closed cell foam plastic. Other materials can be used as structure for cushion 115. A fastener, such as an adhesive or bonding material retains cushion 115 on base 114. Base 114 has a generally rectangular shape. The front of base 114 has front corner projections 116 and 117 and rear corner projections 118 and 119. Corner projections 116 and 117 have pockets 121 and 122 in cylindrical bosses 123 and 124. Bosses 123 and 124 have rear openings 126 and 127 open to pockets 121 and 122.

Figure 36:
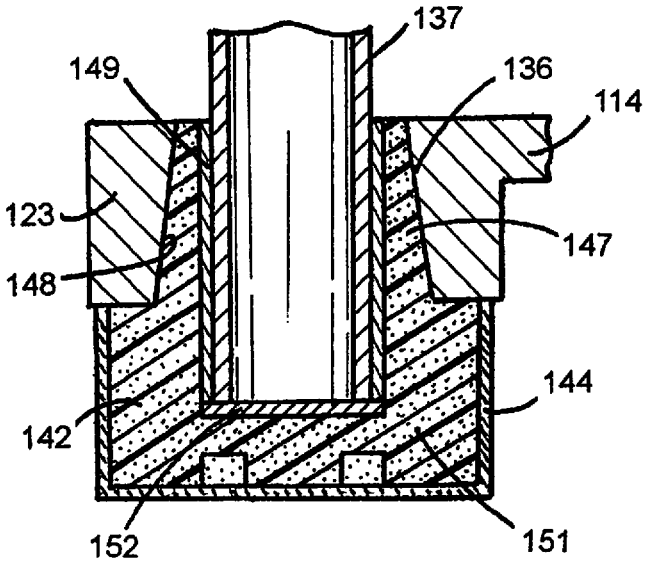
FIG. 36 is a sectional view taken along line 36-36 of FIG. 35.
Figure 37:
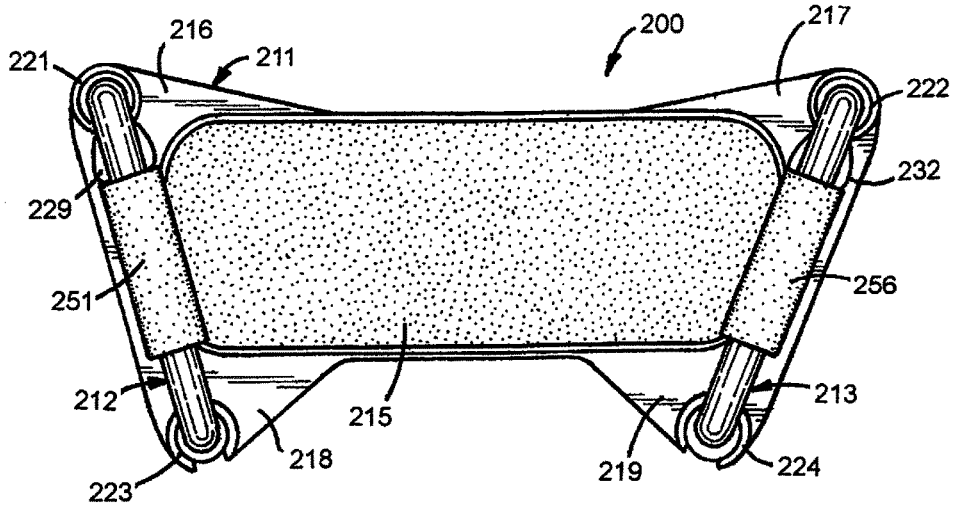
FIG. 37 is a top plan view of a third embodiment of the kneeler of the invention.

Corner projections 118 and 119 have bosses 128 and 129 extended downwardly from base 114. Bosses 128 and 129 have pockets 129 and 131 and rear directed openings 133 and 134 open to pockets 129 and 131. Base 114, corner projections 116, 117, 118 and 119 and bosses 123, 124, 128 and 129 are a one-piece metal member, such as cast aluminum or copper. Other materials and plastic materials can be used to make platform 111. Each of bosses 123, 124, 128 and 129 has an upwardly converging cone shaped wall 136, as shown in FIG. 36.

Handle 112, shown in FIGS. 30 to 34, has legs 137 and 138 joined to cross member 139. Legs 137 and 138 and cross member 139 are a one-piece tubular metal member having an inverted U-shape. Legs 137 and 138 and cross member 139 are made of antimicrobial materials, such as 355 copper alloys registered with the U.S. Environmental Protection Agency. Other metals and materials having antimicrobial properties can be used to make the tubular inverted U-shaped handle 12. A sleeve or hand grip 141 is located on cross member 139. Sleeve 141 is a tubular closed cell foam plastic member surrounding cross member 139.

Feet 142 and 143 are attached to the lower ends of legs 137 and 138. Cup-shaped members 144 and 146 cover the lower portions of feet 142 and 143. Cup-shaped members 144 and 146 are made of antimicrobial materials, such as 355 copper alloys. Feet 142 and 143 have the same structures. Foot 142, shown in FIG. 36, is a rubber or rubber-like member having an upwardly directed stem 147 with a converging tapered outer surface 148 located in compression engagement with tapered wall 136 of boss 123. An upright sleeve 149 located in stem 147 and shoe 151 accommodates the lower end of leg 137. The bottom of leg 137 contacts disk 152 adjacent the bottom of sleeve 149 to fix the location of leg 137 on foot 142.

Handles 112 and 113 are assembled on platform 111 by inserting the lower ends of legs of each handle through openings 126, 133 and 127, 134 into pockets 121, 131 and 122, 134. Platform 111 is then moved down locating the stems of the feet in pockets 121, 131 and 127, 132. Downward movement of platform 111 compresses the rubber material of the stems into compression engagement with the tapered walls of bosses 123, 128 and 124, 129. Handles 112 and 113 are separated from platform 111 by moving platform 111 in an upward direction to release the holding action of the stems of the feet on bosses 123, 128 and 124, 129.

Figure 38:
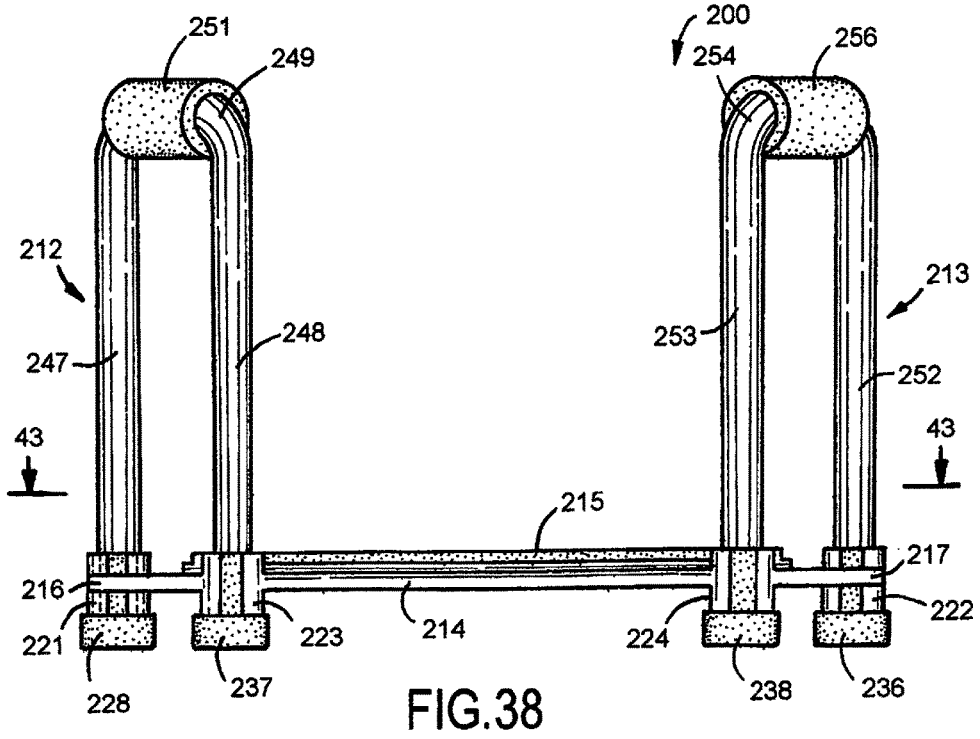
FIG. 38 is a rear elevational view of FIG. 37.
Figure 39:
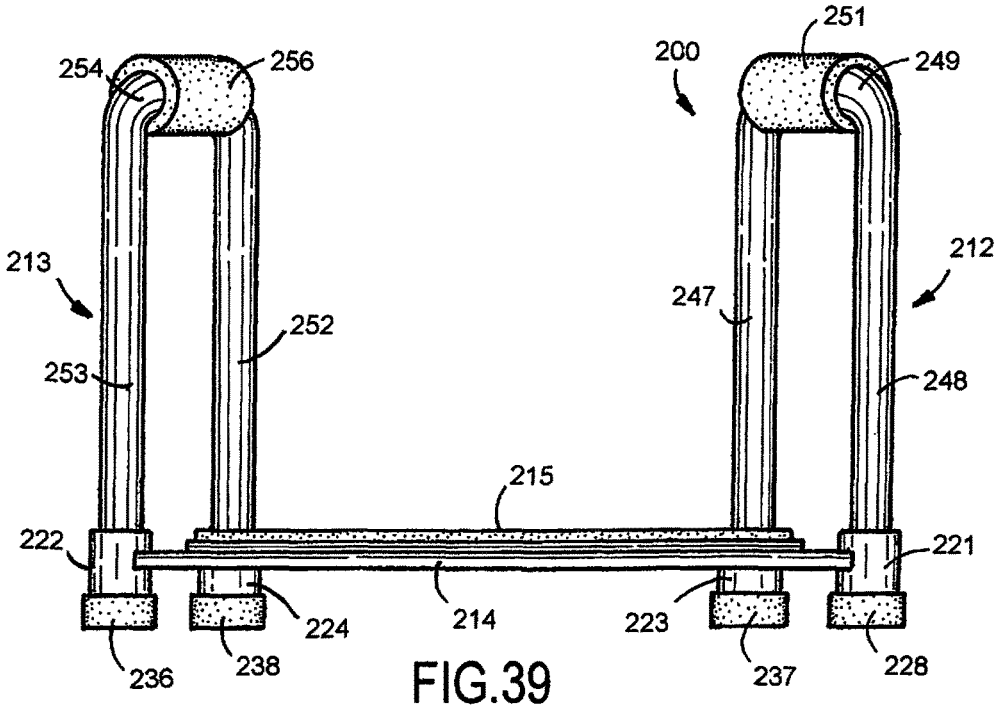
FIG. 39 is a front elevational view of FIG. 37.
Figure 40:
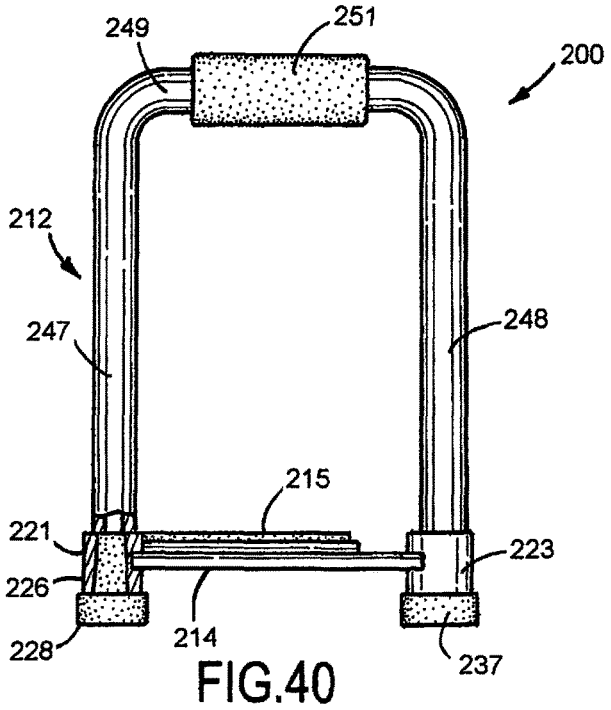
FIG. 40 is a side elevational view of the left side of FIG. 37.
Figure 41:
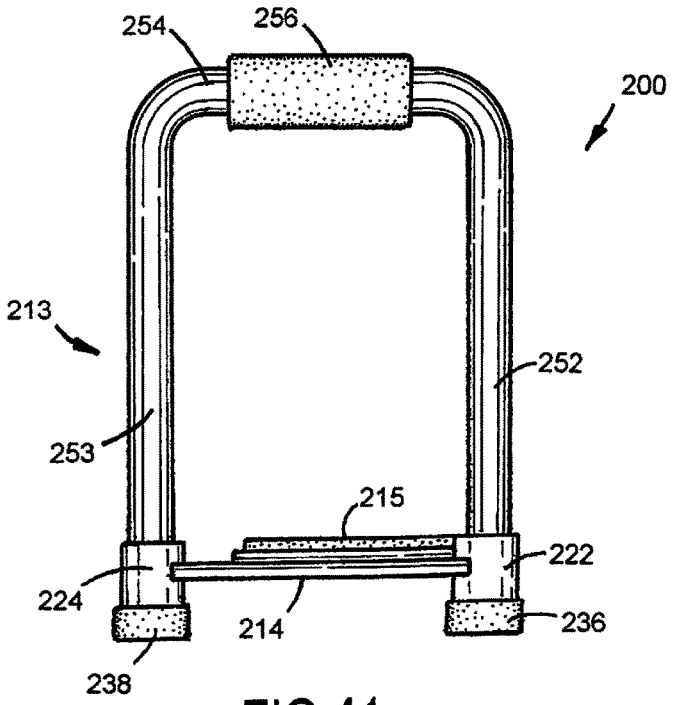
FIG. 41 is side elevational view of the right side of FIG. 37.
Figure 42:
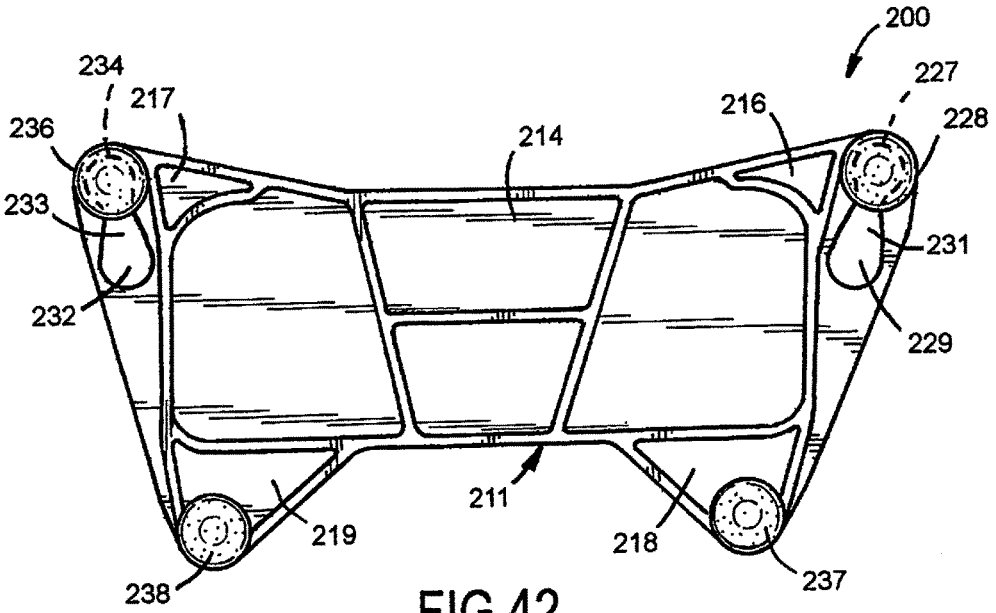
FIG. 42 is a bottom plan view of FIG. 37.
Figure 43:
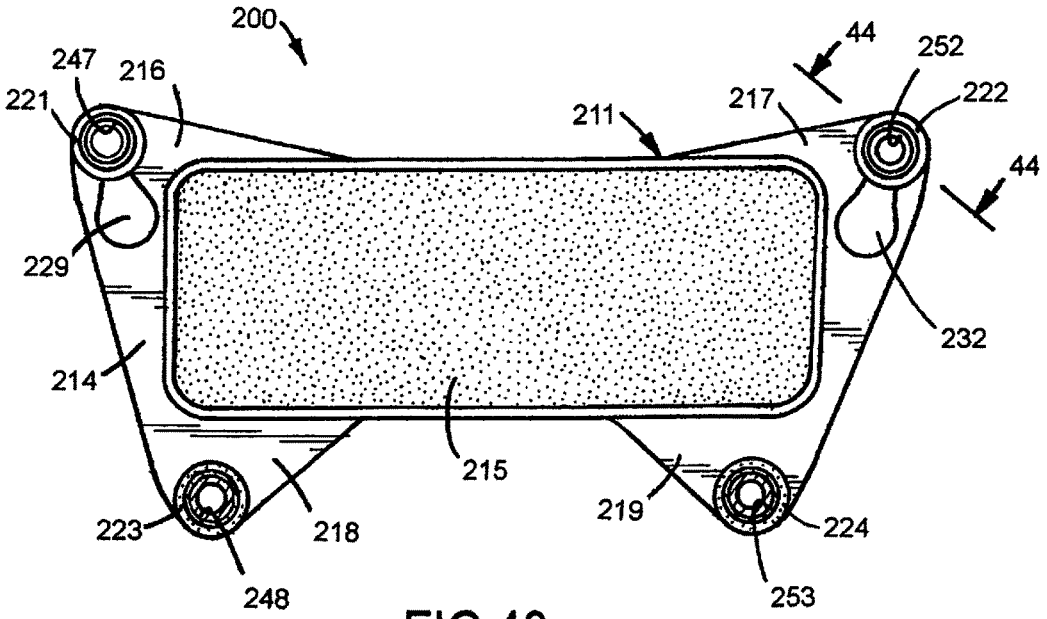
FIG. 43 is a sectional view taken along line 43-43 of FIG. 38.
Figure 44:
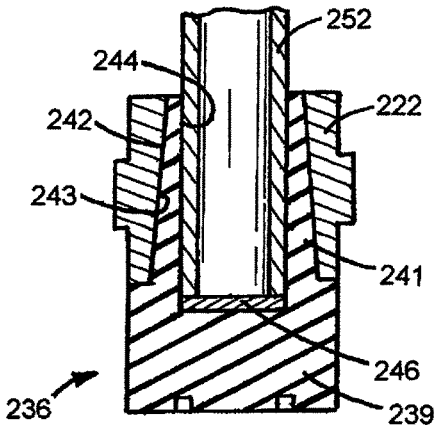
FIG. 44 is an enlarged sectional view taken along line 44-44 of FIG. 43.

A third embodiment of the kneeler 200, shown in FIGS. 37 to 44, has a platform 211 supporting handles 212 and 213. Handles 212 and 213 extend upwardly adjacent opposite ends of platform 211 and function to provide supports for a person using kneeler 200. Platform 211 has a base or plate 214 having a flat top surface supporting a generally rectangular cushion or pad 215. A fastener, such as an adhesive or bonding material, secures cushion 215 to the top surface of base 214. Cushion 215 is an elastic member, such as closed cell plastic. Base 214 has a generally rectangular shape with front corner projections 216 and 217 and rear corner projections 218 and 219. As shown in FIGS. 38 and 39, cylindrical front bosses 221 and 222 are parts of front corner projections 216 and 217. Cylindrical rear bosses 223 and 224 are parts of rear corner projections 218 and 219. As shown in FIG. 40, boss 221 has an upwardly converging conical wall 226 surrounding an upwardly extended pocket 227 accommodating a foot 228. As shown in FIG. 42, corner projection 216 has an opening or hole 229 and a passage 231 open to pocket 227. Opening 229 has a size that permits foot 228 to be moved downward through opening 229 and allow handle 212 to be moved laterally into opening 227. Corner projection 217 has an opening 232 and passage 233 in communication with conical pocket 234 for foot 236. Bosses 223 and 224 have upwardly converging conical walls providing pockets for feet 237 and 238. The pockets are the same size and configuration as pockets 227 and 234. As shown in FIG. 44, foot 236 has a cylindrical sole 239 joined to an upright stem 241. Stem 241 has an upright converging or tapered outside wall 242 located in compression engagement with adjacent tapered wall 243 of boss 222. Stem 241 also has a cylindrical blind hole 244. A washer or disk 246 is located in the base of hole 244. Handles 212 and 213 have the same size and structure. Each handle is releasably attached to platform 211. Handle 212 has upright tubular legs 247 and 248 and a cross member 249. A sleeve or hand grip 251 surrounds cross member 249. Sleeve 251 is a tubular member mounted on cross member 249. The lower ends of legs 247 and 248 are telescoped into blind holes in feet 228 and 237 whereby legs 247 and 248 are secured to feet 228 and 237. Handle 213 has upright legs 252 and 253 joined with a cross member 254. A sleeve or hand grip 256 is mounted on cross member 254. As shown in FIG. 44, the lower end of leg 252 is located in blind hole 244 of stem 241 of foot 236. The bottom of leg 252 contacts disk 246 to fix the location of leg 252 on foot 236 and prevent leg 252 from cutting into the rubber material of foot 236. Legs 247, 248 and 253 are mounted on feet 228, 237 and 238 as shown by leg 252 and foot 236 in FIG. 44.

Handles 212 and 213 are assembled on platform 211 by inserting front feet 228 and 236 through openings 229 and 232. Legs 247, 248, 252 and 253 are laterally moved into the tapered pockets in bosses 221, 222, 223 and 224. Platform 211 is then moved down locating the stems of feet 228, 236, 237 and 238 in compression engagement with bosses 221, 222, 223 and 224. Handles 212 and 213 are separated from platform 211 by moving platform 211 in an upward direction to release the holding action of the stems of the feet on bosses 221, 222, 223 and 224. Front feet 228 and 238 are then moved upward out of openings 229 and 232. Kneeler 200 is separated into three pieces for transport and storage.

Figure 45:
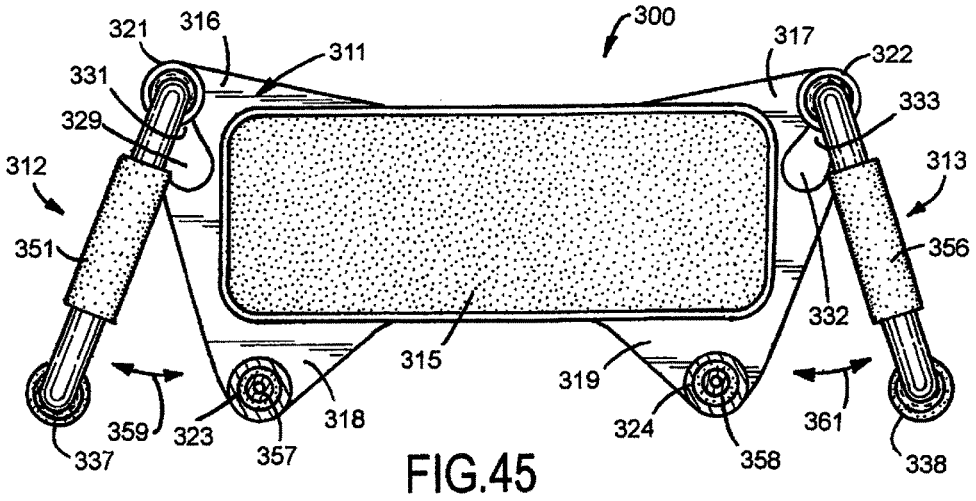
FIG. 45 is a top plan view of a fourth embodiment of the kneeler of the invention.
Figure 46:
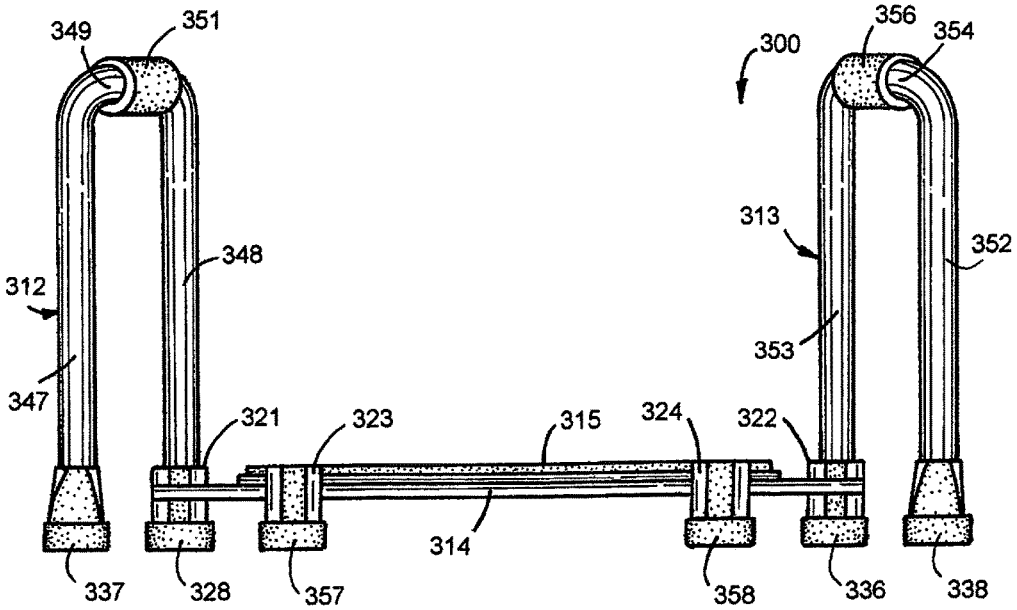
FIG. 46 is a rear elevational view of FIG. 45.
Figure 47:
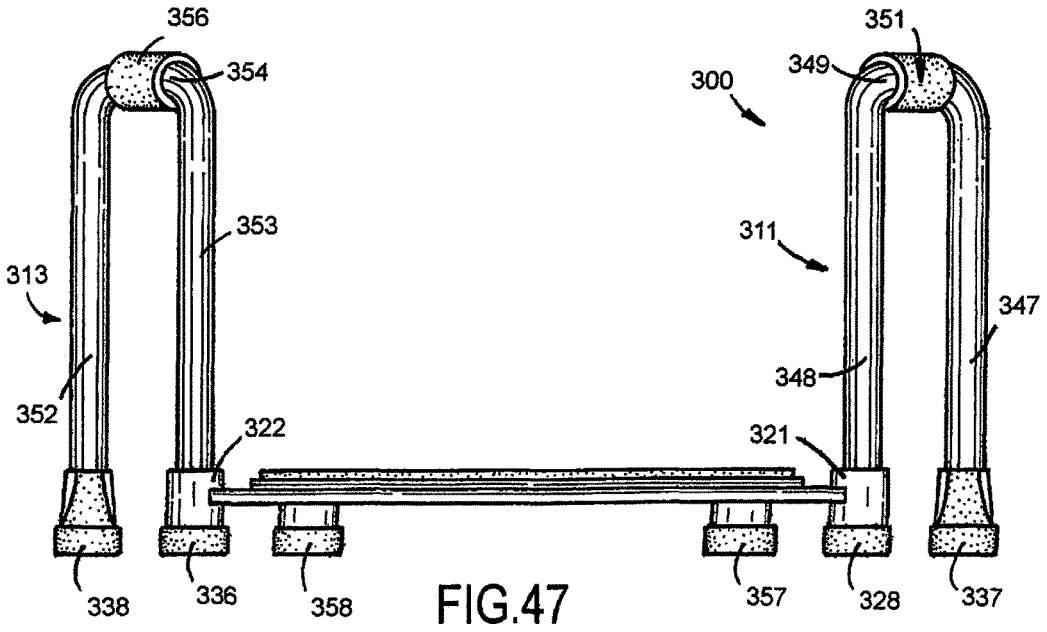
FIG. 47 is a front elevational view of FIG. 45.
Figure 48:
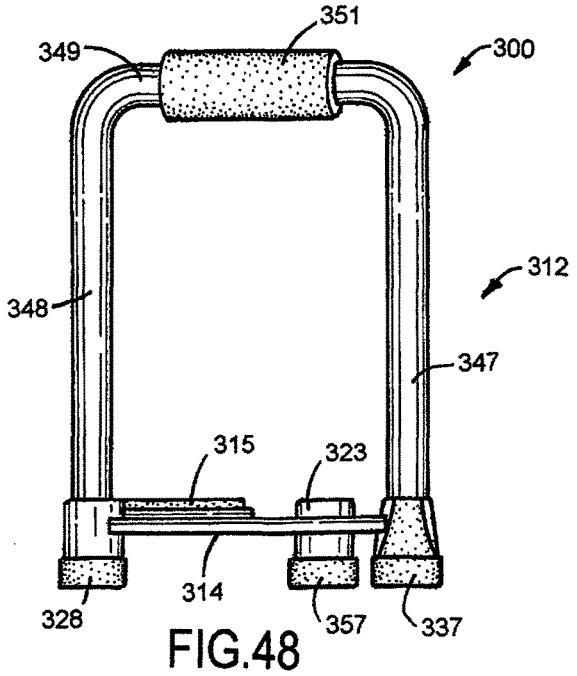
FIG. 48 is a side elevational view of the left side of FIG. 45.
Figure 49:
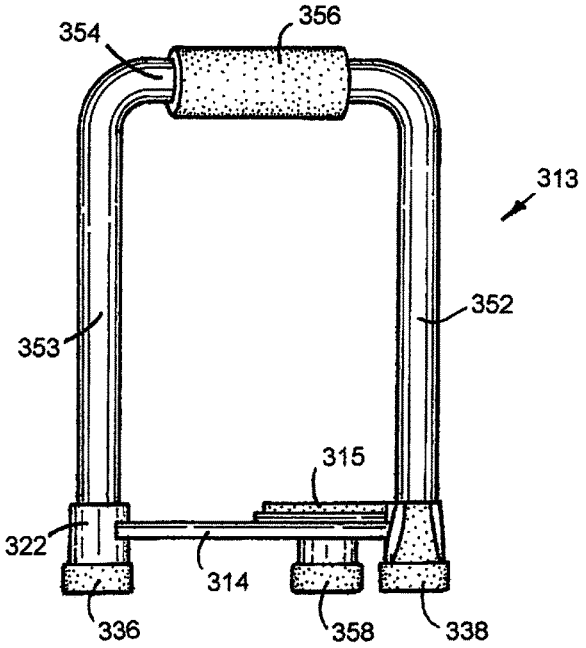
FIG. 49 is a side elevational view of the right side of FIG. 45.
Figure 50:
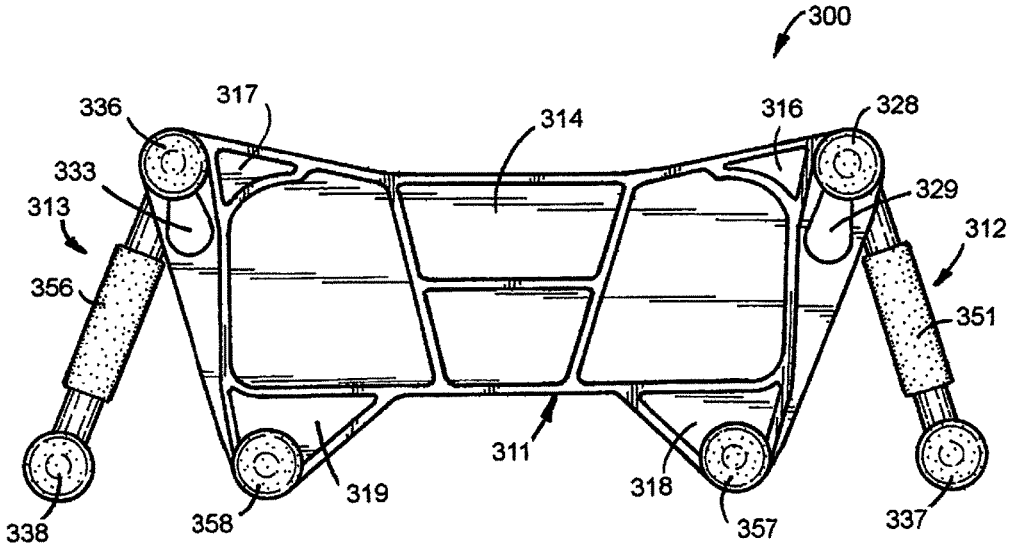
FIG. 50 is a bottom plan view of FIG. 45.

A fourth embodiment of the kneeler 300, shown in FIGS. 45 to 50, has a platform 311 supporting handles 312 and 313. Handles 312 and 313 extend upwardly adjacent opposite ends of platform 311 and function to provide supports for a person using kneeler 300. Platform 311 has a base or plate 314 having a flat top surface supporting a generally rectangular cushion or pad 315. A fastener, such as an adhesive or bonding material, secures cushion 315 to the top surface of base 314. Cushion 314 is an elastic member, such as closed cell plastic. Base 314 has a generally rectangular shape with front corner projections 316 and 317 and rear corner projections 318 and 319. As shown in FIGS. 45 and 46, cylindrical front bosses 321 and 322 are parts of front corner projections 316 and 317. Cylindrical rear bosses 323 and 324 are parts of rear corner projections 318 and 319. Boss 321 has a pocket 327 accommodating a foot 328. As shown in FIG. 45, corner projection 316 has an opening or hole 329 and a passage 331 open to pocket 327. Opening 329 has a size that permits foot 328 to be moved downward through opening 329 and allow handle 312 to be moved laterally into opening 327. Corner projection 317 has an opening 332 and passage 333 in communication with a conical pocket for foot 336. Bosses 323 and 324 have upwardly converging conical walls providing pockets for feet 337 and 338. The pockets are the same size and configuration as pockets 327 and 334. Each handle 312 and 313 is releasably attached to platform 311. Handle 312 has upright tubular legs 347 and 348 and a cross member 349. A sleeve or hand grip 351 surrounds cross member 349. Sleeve 351 is a tubular member mounted on cross member 349. The lower ends of legs 347 and 348 are telescoped into blind holes in feet 328 and 337 whereby legs 347 and 348 are secured to feet 328 and 337. Handle 313 has upright legs 352 and 353 joined with a cross member 354. A sleeve or hand grip 356 is mounted on cross member 354.

As shown in FIG. 45, handles 312 and 313 are angularly moved, as shown by arrows 359 and 361, toward and away from opposite ends of platform 311 to enlarge the rear space between handles 312 and 313. As shown in FIG. 46, additional feet 323 and 324 are mounted on bosses 323 and 324 to maintain handles 312 and 313 in level locations on a support surface. Feet 337 and 338 can be mounted on bosses 323 and 324 as shown in FIG. 43.

Handles 312 and 313 are assembled on platform 311 by first inserting front feet 328 and 336 through openings 329 and 332. Front legs 348 and 353 of handles 312 and 313 are laterally moved into the pockets in bosses 321 and 322. Platform 311 is then moved down locating feet 328 and 336 in compression engagement with bosses 321 and 322. Handles 312 and 313 are then turned away from opposite ends of platform 311 to desired locations. Handles 312 and 313 are separated form platform 311 by moving platform 311 in an upward direction to release the holding action of the feet on bosses 321 and 322. Feet 328 and 336 are moved laterally and raised up through openings 329 and 332 to separate handles 312 and 313 from platform 311.

A fifth embodiment of the kneeler 400, shown in FIGS. 51 to 61, has a platform 411 supporting handles 412 and 413. Handles 412 and 413 extend upward from opposite ends of platform 411 and provide a person with support using kneeler 400. A person can use their arms to move from a standing position to a kneeling position and back to a standing position. Platform 411 has a base or plate 411 having a flat top surface supporting a generally rectangular cushion or pad 415. Cushion 415 has a flat rectangular shape that is located between handles 412 and 413. Elastic material, such as closed cell plastic, can be used as structure for cushion 415. Other materials can be used as structure for cushion 415. A fastener, such as an adhesive or bonding material, retains cushion 415 on base 414.

Figure 51:
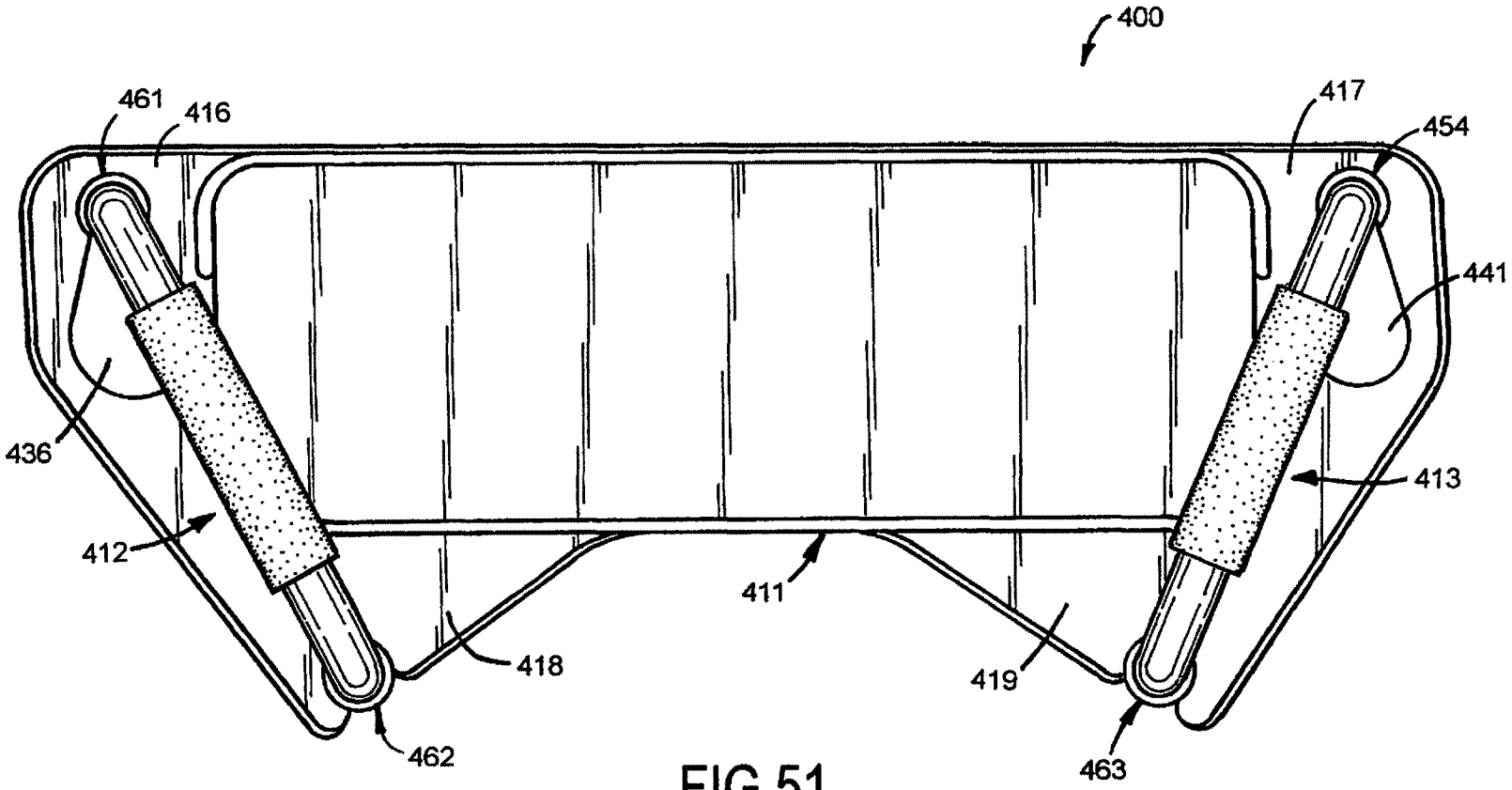
FIG. 51 is a top plan view of a fifth embodiment of the kneeler of the invention.
Figure 52:
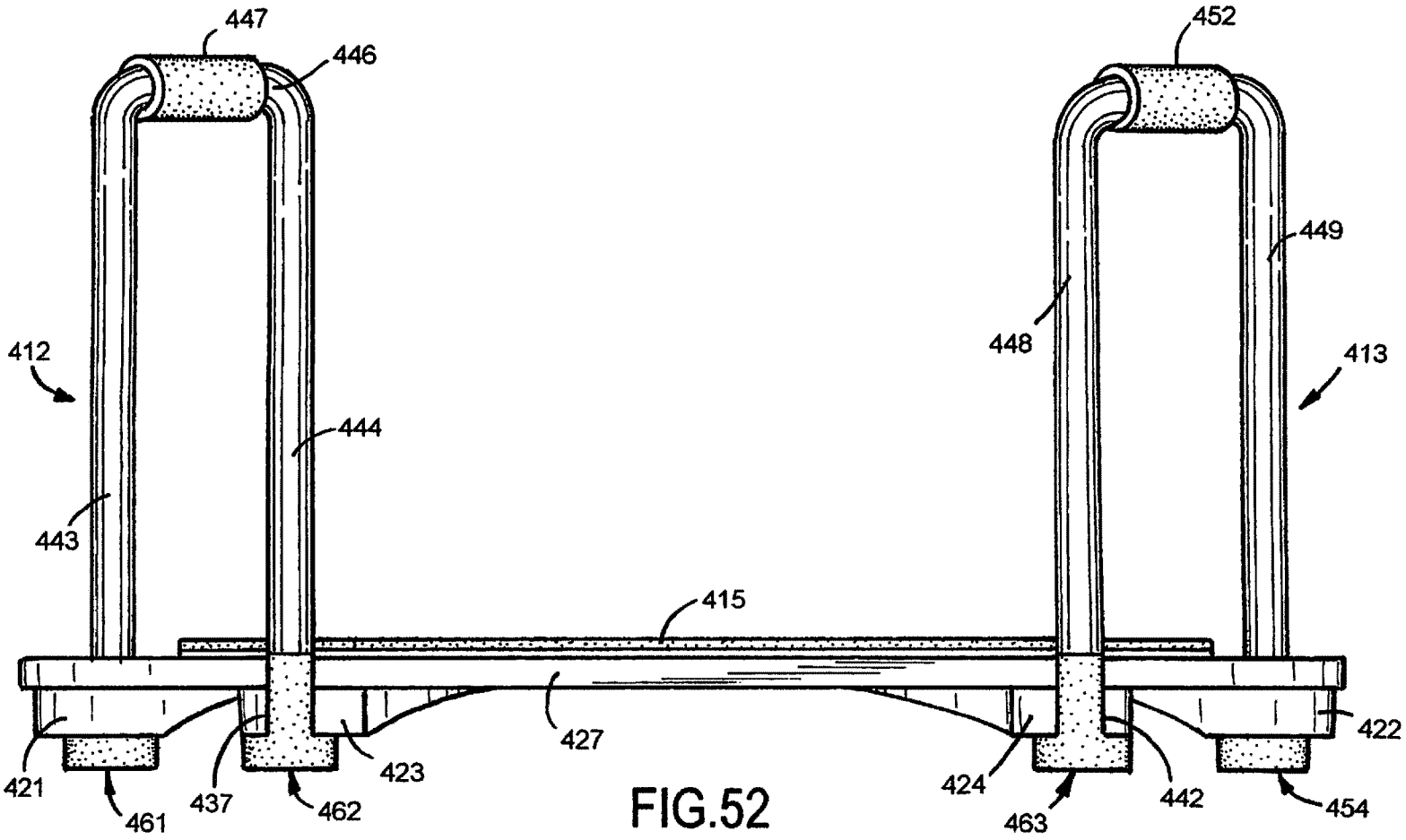
FIG. 52 is a rear elevational view of FIG. 51.
Figure 54:
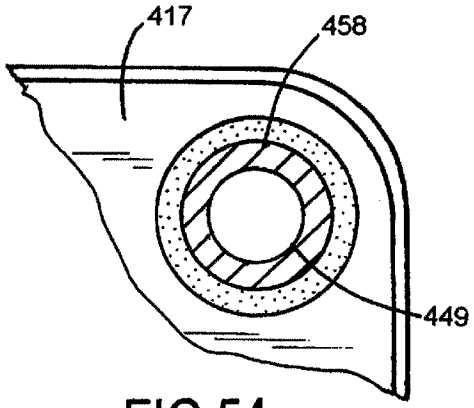
FIG. 54 is a sectional view taken along line 54-54 of FIG. 53.
Figure 55:
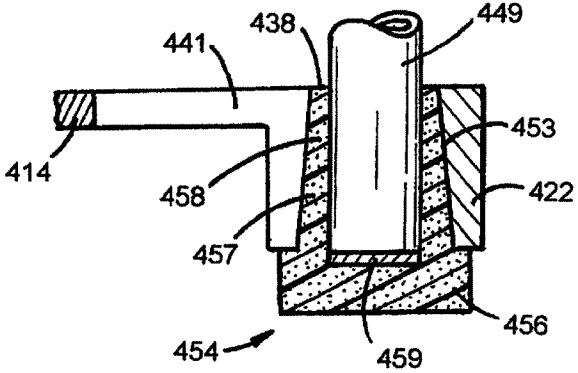
FIG. 55 is an enlarged sectional view taken along line 55-55 of FIG. 53.
Figure 53:
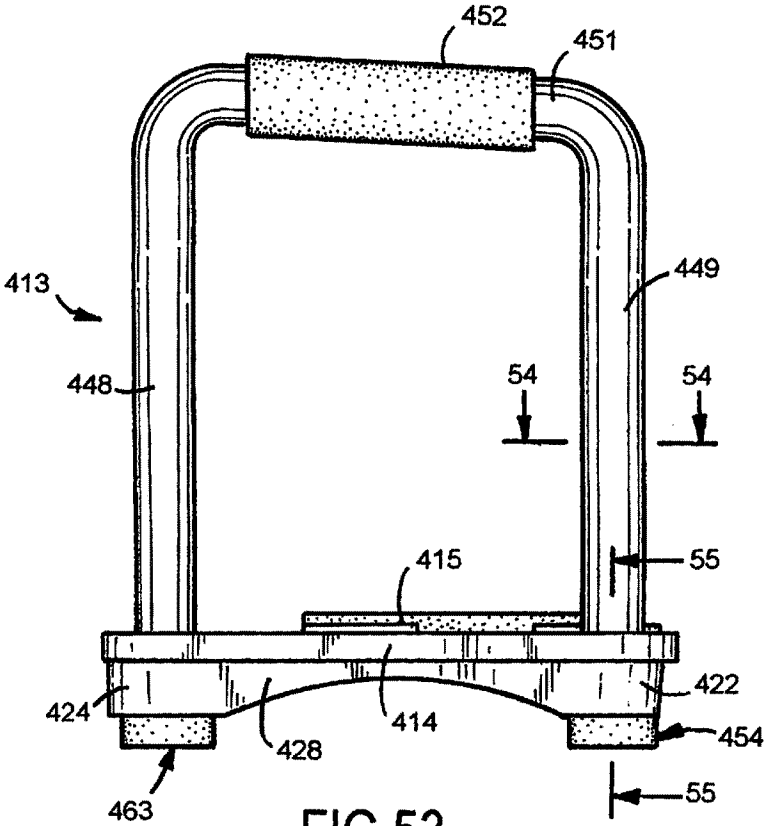
FIG. 53 is a side elevational view of the right side of FIG. 51.
Figure 56:
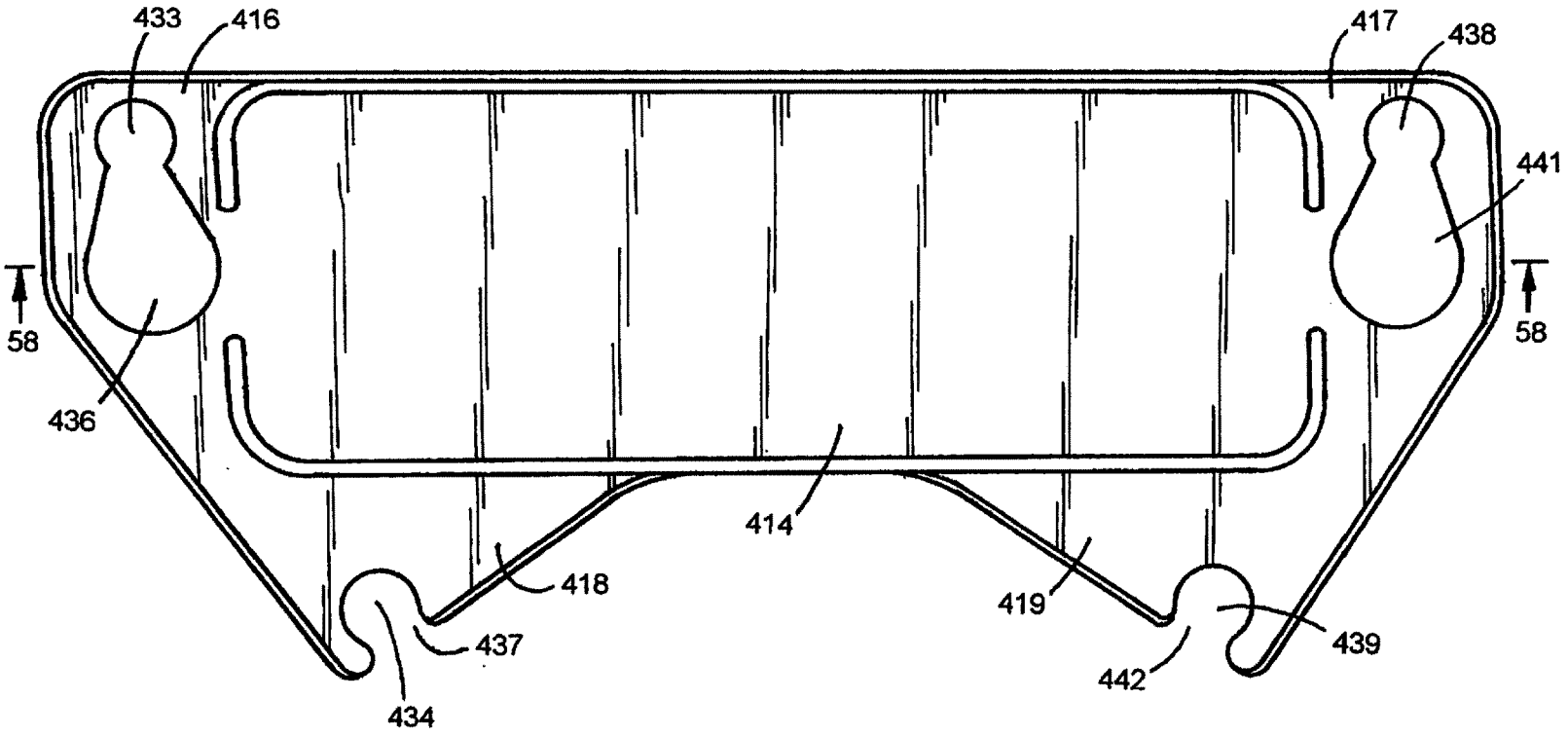
FIG. 56 is a top plan view of the platform of the kneeler of FIG. 51.
Figure 57:
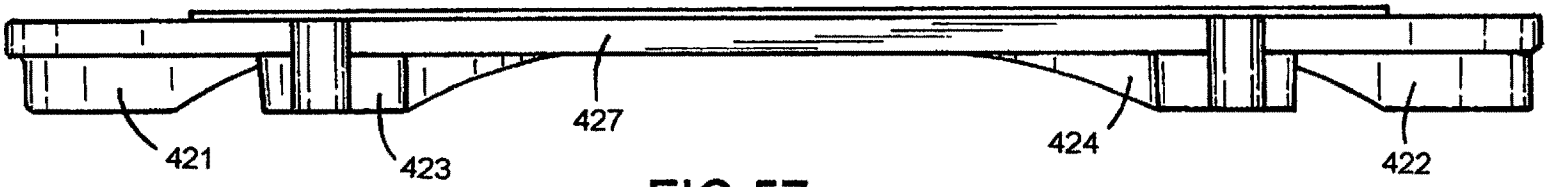
FIG. 57 is a rear elevational view of FIG. 56.
Figure 58:
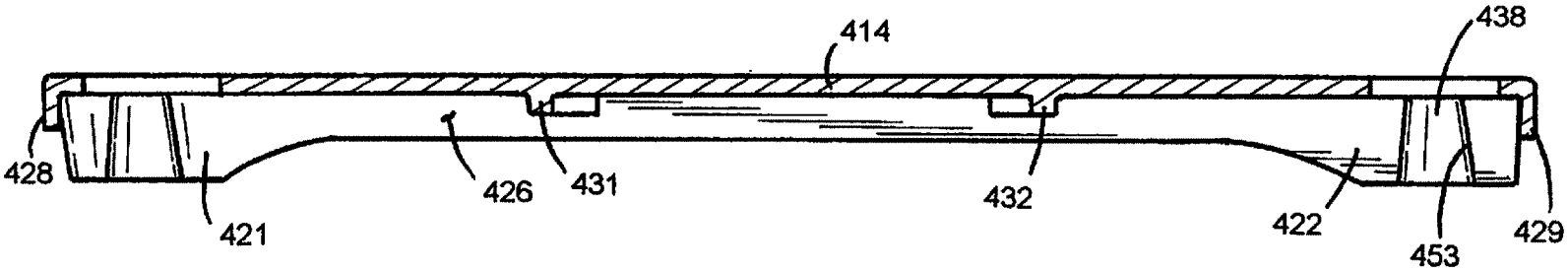
FIG. 58 is a sectional view taken along line 58-58 of FIG. 56.
Figure 60:
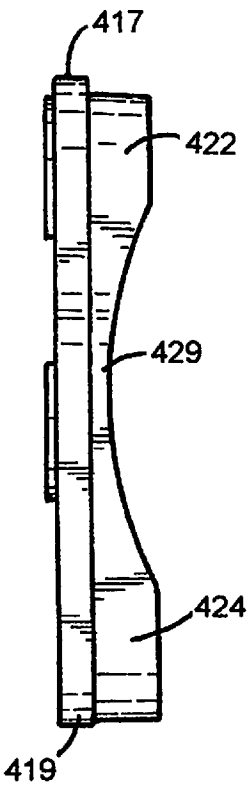
FIG. 60 is an end view of the right end of FIG. 56.
Figure 59:
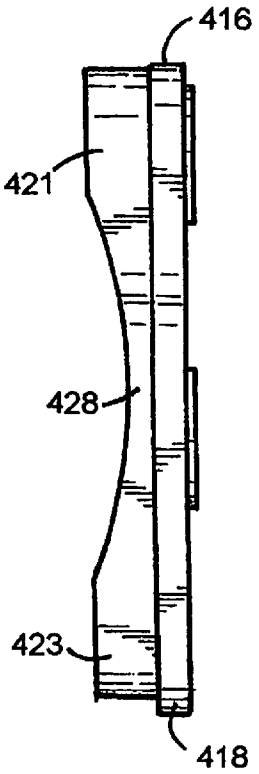
FIG. 59 is an end view of the left end of FIG. 56.

As shown in FIGS. 51 and 56, platform 411 has front corner portions 416 and 417 and rear corner portions 418 and 419. Front bosses 421 and 422, shown in FIGS. 52, 57 and 61, joined to front corner portions 416 and 417 extend downward from base 414. Rear bosses 423 and 424 joined to rear corner portions 418 and 419 extend downward from base 414. Bosses 421, 422, 423 and 424 have bottom surfaces located in a common horizontal plane. Returning to FIG. 61, base 414 has a linear front rib 426 extended between bosses 421 and 422 and a rear rib 427 extended between bosses 423 and 424. A first end rib 428 extends between bosses 421 and 423. A second end rib 429 extends between bosses 422 and 424. Curved ribs 430 and 431 connect middle sections of ribs 426 and 427. Ribs 427 to 431 reinforce base 414 and bosses 421 and 424. Base 414 including bosses 421, 422, 423 and 424 and ribs 427 to 431 comprise a one-piece cast metal member, such as an aluminum casting. Other materials including plastic and fiber reinforced plastic can be used as structure for the one-piece base 414.

Figure 61:
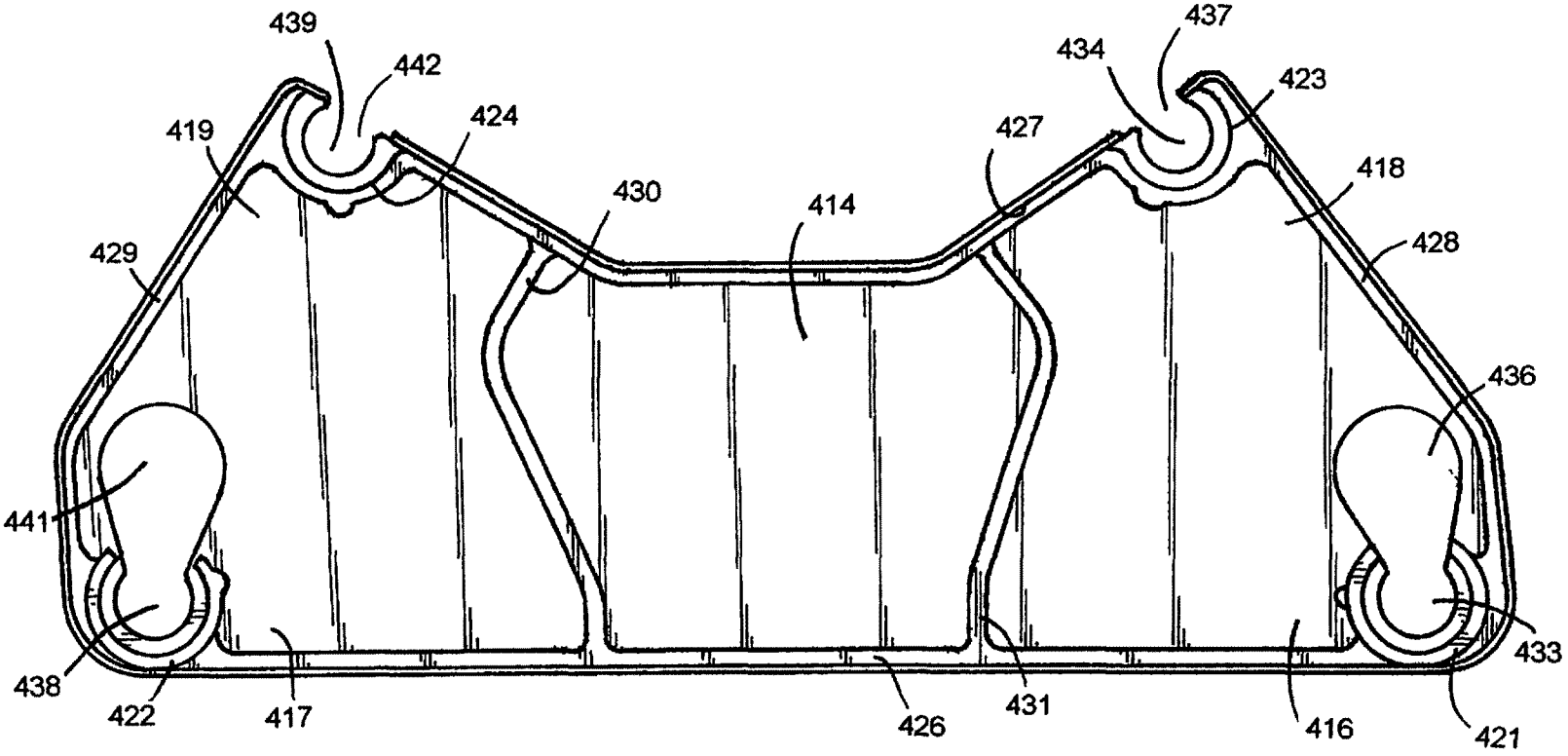
FIG. 61 is a bottom plan view of FIG. 56.

As shown in FIGS. 56 and 61, corner portions 414 and 418 have pockets 433 and 434. An opening 436 in base 414 communicates with pocket 433. A passage 437 in boss 423 and base 414 opens pocket 434 toward to back of platform 411. Corner portions 417 and 419 have pockets 438 and 439. An opening 441 in base 414 communicates with pocket 438. A passage 442 in boss 424 and base 414 opens pocket 439 toward the back of platform 411.

Handle 412 has upright legs 443 and 444 joined with a cross member 446. A tubular sleeve or hand grip 447 is located around cross member 446. Handle 413 has upright legs 448 and 449 joined with cross member 451. A sleeve or hand grip 452 is located around cross member 446. Handles 412 and 413 are inverted U-shaped one-piece metal tubular members. Steel, aluminum, and copper alloys can be used to fabricate the one-piece tubular members.

Pockets 433, 434, 438 and 439 each have upwardly converging conical side walls. Pocket 438, shown in FIG. 55, has a conical side wall 453 in boss 422. Side wall 453 tapers inwardly in an upright direction from the bottom of boss 422 to the top surface of base 414. Opening 441 is open to a portion of side wall 453 to allow the lower end of leg 449 to move from opening 441 to pocket 438.

A foot 454 attached to the lower end of leg 449 fits in pocket 438 thereby connecting foot 454 and leg 449 to boss 422. Foot 454 is a rubber member having a cylindrical sole or base 456 and an upright stem 457. Stem 457 has an upward converging conical side wall 458 located in compression engagement with conical side wall 453 of boss 422. A cylindrical blind hole in stem 457 accommodates the lower end of leg 449. The bottom end of leg 449 engages a washer or disk 459. Disk 459 prevents leg 449 from cutting down into shoe 456. The lower end of leg 449 has a tight press fit in stem 458. Bond material can be used to secure leg 449 to stem 458. Feet 461, 462 and 463 mounted on bosses 421, 423 and 424 have the same structure as foot 454.

Handles 412 and 413 are assembled on platform 411 by inserting the front feet 454 and 461 down through openings 441 and 436 to locate feet 454 and 461 below platform 411. Feet 462 and 463 are also located below platform 411. Handles 412 and 413 are separately moved laterally to locate the lower ends of the legs of handles 412 and 413 into adjacent pockets 433, 434, 438 and 439. Platform 411 is then moved down located the stems of feet 454, 461, 462 and 463 in tight compression engagement with bosses 421, 422, 423 and 424. Handles 412 and 413 are separated from platform 411 by moving platform 411 in an upward direction to release the holding action of the stems of feet 454, 461, 462 and 463 on bosses 421, 422, 423 and 424. Handles 412 and 413 are then laterally moved to move the legs of the handle out of pockets 433, 434, 438 and 439. Front feet 454 and 461 are then lifted up through openings 441 and 436 to separate handles 412 and 413 from platform 411.

Preferred embodiments of the kneeler has been illustrated and described. Change sin the structures and materials of the kneeler may be made by a person skilled in the art without departing from the kneeler and handle defined in the following claims.

The invention claimed is:

1. A kneeler for supporting a person in a kneeling position and facilitating a person to move from an upright position to a kneeling position and arising from a kneeling position back to an upright position comprising:

a platform having a first side wall and a second side wall opposite the first side wall, a top wall and a bottom wall opposite the top wall, said first side wall having spaced first and second pockets, said first and second pockets being open to the top and bottom walls, said second side wall having spaced third and fourth pockets, said third and fourth pockets being open to the top and bottom walls, a first handle having first and second legs, first and second feet mounted on the first and second legs, said first and second feet located in the first and second pockets to retain the first handle on the platform, said first and second feet each having a base engageable with the bottom wall of the platform, a second handle having first and second legs, and third and fourth feet mounted on the first and second legs of the second handle, said third and fourth feet mounted on the third and fourth pockets to retain the second handle on the platform, and said third and fourth feet each having a base engageable with the bottom wall of the platform whereby the first, second, third and fourth feet support the platform on a surface.

2. The kneeler of claim 1 wherein:

the first and second handles comprise antimicrobial copper members and an antimicrobial copper member mounted on each base of said first, second, third and fourth feet.

3. The kneeler of claim 1 wherein:

the first and second legs of the first handle comprise antimicrobial copper members and the third and fourth legs of the second handle comprise antimicrobial copper members.

4. The kneeler of claim 1 wherein:

the first handle is an inverted U-shaped member including the first and second legs and a first cross member joined to the first and second legs, a first sleeve located on the first cross member, the second handle is an inverted U-shaped member including the third and fourth legs and a second cross member joined to the third and fourth legs, and a second sleeve located on the second cross member.

5. The kneeler of claim 1 wherein:

the first side wall has a first opening open to the first and second pockets, said first and second legs of the first handle extended through the first opening when the first and second feet are located in the first and second pockets, the second side wall has a second opening open to the third and fourth pockets, and said first and second legs of the second handle extended through the second opening when the third and fourth feet are located in the third and fourth pockets.

6. A kneeler for supporting a person in a kneeling position and facilitating a person to move from an upright position to a kneeling position and arising from a kneeling position back to an upright position comprising:

a platform having a first side wall and a second side wall opposite the first side wall and a bottom wall, said first wall having spaced first and second pockets and a first opening extended between and open to the first and second pockets, said second side wall having spaced third and fourth pockets and a second opening extended between and open to the third and fourth pockets, a first handle having first and second legs extended through the first opening, first and second feet mounted on the first and second legs, said first and second feet located in the first and second pockets to retain the first handle on the platform, a second handle having first and second legs extended through the second opening, third and fourth feet mounted on the first and second legs of the second handle, said third and fourth feet located in the third and fourth pockets to retain the second handle on the platform, and said first, second, third and fourth feet each having a base engageable with the bottom wall of the platform whereby the first, second, third and fourth feet support the platform on a surface.

7. The kneeler of claim 6 wherein:

the first side wall includes first and second bosses, said first and second bosses having the first and second pockets, the second side wall includes third and fourth bosses, and said third and fourth bosses having the first and fourth pockets.

8. The kneeler of claim 7 wherein:

the first boss has an opening open to the first pocket, the second boss has an opening open to the second pocket, the third boss has an opening open to the third pocket, and the fourth boss has an opening open to the fourth pocket.

9. The kneeler of claim 6 wherein:

the first and second legs of the first handle comprise antimicrobial copper members and the third and fourth legs of the second handle comprise antimicrobial copper members.

10. The kneeler of claim 6 wherein:

the first handle is an inverted U-shaped member including the first and second legs and a first cross member joined to the first and second legs, a first sleeve located on the first cross member, the second handle is an inverted U-shaped member including the third and fourth legs and a second cross member joined to the third and fourth legs, and a second sleeve located on the second cross member.

11. The kneeler of claim 6 wherein:

the first, second, third and fourth feet each include a stem located in the first, second, third and fourth pockets, and said base joined to the stem for supporting the platform on a surface.

12. A kneeler for supporting a person in a kneeling position and facilitating a person to move from an upright position to a kneeling position and arising from a kneeling position back to an upright position comprising:

a platform having a first side and a second side opposite the first side, the first side including a first front corner and a second rear corner, said second side including a third front corner and a fourth rear corner, a first boss joined to and extended downwardly from the first corner of the platform, a second boss joined to and extended downward from the second corner of the platform, a third boss joined to and extended downward from the third corner of the platform, a fourth boss joined to and extended from the fourth corner of the platform, each of said first, second, third and fourth bosses having walls providing first, second, third and fourth pockets and an opening open to each of the pockets, a first handle having first and second legs, a first foot mounted on the first leg, said first foot having a first sole and an upright stem located in the first pocket in surface engagement with the wall around the first pocket, said first sole being engageable with the first boss and supporting the platform on a surface, a second foot mounted on the second leg, said second foot having a second sole and an upright stem located in the second pocket in surface engagement with the wall around the second pocket, said second sole being engageable with the second boss and supporting the platform on the surface, a second handle having first and second legs, a third foot mounted on the first leg of the second handle, said third foot having a third sole and an upright stem located in the third pocket in surface engagement with the wall around the third pocket, said third sole being engageable with the third boss and supporting the platform on the surface, a fourth foot mounted on the second leg of the second handle, said fourth foot having a fourth sole and an upright stem located in the fourth pocket in surface engagement with the wall around the fourth pocket, said fourth sole being engageable with the fourth boss and supporting the platform on the surface, said openings in the bosses open to the pockets each having a portion thereof smaller in size than the size of the stems of the first, second, third and fourth feet whereby the stems of the first, second, third and fourth feet when located in the first, second third and fourth pockets attach the first and second handles to the bosses of the platform and when moved out of the first, second, third and fourth pockets separate the first and second handles from the bosses of the platform.

13. The kneeler of claim 12 wherein:

the first and third corners of the platform are laterally aligned and the second and fourth corners of the platform are laterally aligned.

14. The kneeler of claim 12 wherein:

the first and second legs of the first handle comprise antimicrobial copper members and the third and fourth legs of the second handle comprise antimicrobial copper members.

15. The kneeler of claim 12 wherein:

the first handle is an inverted U-shaped member including the first and second legs and a first cross member joined to the first and second legs, a first sleeve located on the first cross member, the second handle is an inverted U-shaped member including the third and fourth legs and a second cross member joined to the third and fourth legs, and a second sleeve located on the second cross member.

16. The kneeler of claim 15 wherein:

the first and second legs and first cross member and the third and fourth legs and second cross member comprise antimicrobial copper members.

17. The kneeler of claim 12 wherein:

the platform has a flat top surface located between the first and second handle, a cushion located on and covering said flat top surface of the platform, and attaching material securing the cushion to said flat top surface of the platform.

18. A kneeler for supporting a person in a kneeling position and facilitating a person to move from an upright position to a kneeling position and arising from a kneeling position back to an upright position comprising:

a platform having a first side and a second side opposite the first side, a first handle attached to the first side of the platform, a second handle attached to the second side of the platform, first and second bosses on the first side of the platform, each of said first and second bosses having a wall providing first and second pockets, said first boss having a first opening in communication with the first pocket, said second boss having a second opening open in communication with the second pocket, third and fourth bosses on the second side of the platform, each of said third and fourth bosses having a wall providing third and fourth pockets, said third boss having a third opening in communication with the third pocket, said fourth boss having a fourth opening in communication with the fourth pocket, said first handle having first and second legs, a first foot mounted on the first leg, said first foot having a first sole and a first stem joined to the first sole, said first stem being located in the first pocket in surface engagement with the wall around the first pocket of the first boss, said first sole of the first foot engaging the first boss for supporting the platform on a surface, a second foot mounted on the second leg, said second foot having a second sole and a second stem joined to the second sole, said second stem being located in the second pocket in surface engagement with the wall around the second pocket, said second sole of the second foot engaging the second boss for supporting the platform on the surface, said second handle having first and second legs, a third foot mounted on the first leg of the second handle, said third foot having a third sole and a third stem joined to the third sole, said third stem being located in the third pocket in surface engagement with the wall around the third pocket, said second sole of the third foot engaging the third boss for supporting the platform on the surface, a fourth foot to mounted on the second leg of the second handle, said fourth foot having a fourth sole and a fourth stem joined to the fourth sole, said fourth stem being located in the fourth pocket in surface engagement with the wall around the fourth pocket, said fourth sole of the fourth foot engaging the fourth boss for supporting the platform on the surface, said first, second, third and fourth openings in the first, second, third and fourth bosses each have a portion thereof smaller in size than the size of the stems of the first, second, third and fourth feet whereby the first and second legs of the first and second handles can be moved through the first, second, third and fourth openings and the stems of the first, second, third and fourth feet can be moved into the first, second, third and fourth pockets to attach the first and second handles to the bosses and moved out of the first, second, third and fourth pockets to remove the first and second handles from the bosses of the platform.

19. The kneeler of claim 18 wherein:

the first opening has an entrance open to the first pocket, the second opening has an entrance open to the second pocket, the third opening has an entrance open to the third pocket, and the fourth opening has au entrance open to the fourth pocket.

20. The kneeler of claim 18 wherein:

the first and second legs of the first handle comprise antimicrobial copper members and the first and second legs of the second handle comprise antimicrobial copper members.

21. The kneeler of claim 18 wherein:

the first handle is an inverted U-shaped member including the first and second legs and a first cross member joined to the first and second legs, a first sleeve located on the first cross member, the second handle is an inverted U-shaped member including the first and second legs of the second handle and a second cross member joined to the first and second legs of the second handle, and a second sleeve located on the second cross member.

22. The kneeler of claim 21 wherein:

the first and second legs and first cross member and the first and second legs and second cross member comprise antimicrobial copper members.

23. The kneeler of claim 18 wherein:

the platform has a flat top surface located between the first and second handles, a cushion located on and covering said flat top surface of the platform, and attaching material securing the cushion to said flat top surface of the platform.

24. The kneeler of claim 18 including:

an antimicrobial copper cup-shaped member mounted on each of the soles of the first, second, third and fourth feet.

* * * * *